US011993870B2

(12) United States Patent
Grange et al.

(10) Patent No.: US 11,993,870 B2
(45) Date of Patent: May 28, 2024

(54) SHEDDING MACHINE FOR A LOOM AND ADJUSTING METHOD THEREOF

(71) Applicant: STAUBLI FAVERGES, Faverges-Seythenex (FR)

(72) Inventors: Hervé Grange, Cesarches (FR); Eric Brondex, Saint-Jorioz (FR); Pedro Bernardo, Saint Jorioz (FR); Mickael Vernoit, Annecy (FR); Bastien Tardy, Argonay (FR)

(73) Assignee: STAUBLI FAVERGES, Faverges-Seythenex (FR)

( * ) Notice: Subject to any disclaimer, the term of this patent is extended or adjusted under 35 U.S.C. 154(b) by 87 days.

(21) Appl. No.: 17/938,904

(22) Filed: Sep. 6, 2022

(65) Prior Publication Data

US 2023/0075656 A1 Mar. 9, 2023

(30) Foreign Application Priority Data

Sep. 6, 2021 (FR) ..... 2109314

(51) Int. Cl.
*D03C 13/00* (2006.01)
*D03C 9/06* (2006.01)

(52) U.S. Cl.
CPC ... *D03C 13/025* (2013.01); *D03C 2700/0133* (2013.01)

(58) Field of Classification Search
CPC ..... D03C 13/025; D03C 2700/0133; D03C 1/142; D03C 1/146; D03C 1/148; D03C 9/0683
See application file for complete search history.

(56) References Cited

U.S. PATENT DOCUMENTS 690,388 A * 1/1902 Asimos ..... D03C 1/06 139/75
720,181 A * 2/1903 Salisbury ..... D03D 47/26 139/133

(Continued)

FOREIGN PATENT DOCUMENTS

DE 102008032718 B3 12/2009
EP 0574081 A1 12/1993

(Continued)

OTHER PUBLICATIONS

Search Report Issued in FR 2109314, dated Apr. 26, 2022.

*Primary Examiner* — Robert H Muromoto, Jr.
(74) *Attorney, Agent, or Firm* — MARSHALL, GERSTEIN & BORUN LLP

(57) ABSTRACT

A shedding machine includes an eccentric system rotatable about a main axis; a lever; and a transmission rod, coupled to the eccentric system and pivotally to the lever about the eccentric axis and connecting rod axis spaced apart by a connecting rod center distance, the main axis and the eccentric axis being spaced apart by an eccentric center distance. To facilitate the adjustment of the stroke of a heald frame operated by the machine, which includes an adjustment system, allowing an adjustment configuration where the eccentric distance or connecting rod distance is adjustable, and a locked configuration where these distances are fixed. The machine also includes a locking system, which allows lever locking and lever release configurations.

24 Claims, 17 Drawing Sheets

(56) References Cited

U.S. PATENT DOCUMENTS 787,026 A * 4/1905 Dietz ..... D03C 1/06 139/328
839,435 A * 12/1906 Staeubli ..... D03C 7/00 139/53
1,035,353 A * 8/1912 Jones ..... D03C 5/005 139/79
1,077,757 A * 11/1913 Ryon ..... D03C 9/0691 139/73
1,752,621 A * 4/1930 Thexton, Jr. ..... D03C 1/00 139/24
1,753,457 A * 4/1930 Thexton, Jr. ..... D03C 1/00 139/24
2,438,796 A * 3/1948 Zollikofer ..... D03C 1/06 139/72
2,654,397 A * 10/1953 Darash ..... D03D 49/20 139/336
2,693,828 A * 11/1954 Nims ..... D03C 5/005 139/57
2,956,588 A * 10/1960 Pfarrwaller ..... D03D 51/085 139/1 R
2,980,145 A * 4/1961 Herard, Jr. ..... D03C 1/04 139/57
3,422,859 A * 1/1969 Malchair ..... D03D 37/00 139/66 R
3,612,109 A * 10/1971 Pfarrwaller ..... D03D 49/20 139/304
4,527,597 A * 7/1985 Yoshida ..... D03C 15/00 139/319
4,727,910 A * 3/1988 Surkamp ..... D06B 23/18 139/76
4,865,082 A * 9/1989 Zollinger ..... F16D 43/26 139/309
5,000,229 A * 3/1991 Akaishi ..... D03C 9/0683 24/637
7,114,527 B2 * 10/2006 Von Zwehl ..... D03D 51/007 139/1 R
2011/0290368 A1 * 12/2011 Lehmann ..... D03D 51/06 139/1 E

FOREIGN PATENT DOCUMENTS

EP 1489208 A1 12/2004
EP 3831991 A1 6/2021
FR 2734610 A1 11/1996
FR 2856412 A1 12/2004
FR 2977592 A1 1/2013

* cited by examiner

-5A-

-5B-

-5C-

-5D-

-6A-

-6B-

-6C-

SHEDDING MACHINE FOR A LOOM AND ADJUSTING METHOD THEREOF

FIELD

The present invention relates to a shedding machine for a loom, the loom including such a machine, and a method for adjusting the machine.

BACKGROUND

The invention relates to the technical field of shedding machines of the rod-to-frame actuator type, for a heald frame loom.

It is known to employ a plurality of electric frame actuators to drive heald frames in vertical oscillations. According to the technology employed, the electric actuators produce either oscillating rotation or continuous rotation. In both cases, each electric actuator drives the corresponding heald frame by means of a pulling mechanism, comprising a crankpin, connecting rods and levers, which transform the rotation produced by the actuator into a reciprocating translation of the heald frame. During the operation of the loom, especially when changing articles, it may be necessary to adjust the amplitude and height of the heald frame stroke. Changing the amplitude means changing the opening angle of the warp shed. Changing the height is equivalent to changing the height of the warp sheet crossing.

EP14989208A1 describes a shedding device including an electrically powered oscillating rotation actuator. In this case, the amplitude and height of the heald frame stroke depends on the oscillation stroke of the actuator. However, implementing an oscillating actuator, rather than a continuously rotating actuator, involves severe design constraints, which would make it difficult to achieve a high range of adjustment, or limit the maximum load and speed that the actuator can provide.

FR2977592A1 and FR2734610A1 each describe a shedding device, where a heald frame actuating lever is connected to the crank rod system by means of an adapter or yoke, the position of which is manually adjustable, along an arm belonging to the lever and which can be fixed with a clamping screw. However, adjusting this type of system by hand can be tedious and difficult to achieve accuracy.

DE102008032718B3 describes a shedding device where the eccentricity of an eccentric device is adjustable, by moving an eccentric connecting rod drive disc, relative to a connecting element, which is itself rotated by the actuator. The adjustment is performed manually by means of an adjustment rod. One drawback to this type of adjustment is that the adjustable parts may be difficult to access, a high number of screwing or unscrewing steps is required for adjustment, and a high level of skill is required to perform the adjustment.

SUMMARY

The invention aims to remedy the drawbacks of the prior art by providing a new shedding machine where the adjustment of the reciprocating stroke in translation of the heald frame is facilitated.

The object of the invention is a shedding machine for operating a heald frame of a loom according to a reciprocating stroke in translation along an axis of the frame. The shedding machine comprises: a rotary electric actuator; a controller adapted to control the rotary electric actuator; an eccentric system, which comprises: a base by means of which the eccentric system is rotated, by the rotary electric actuator, about a main axis perpendicular to the axis of the frame, and a connecting piece defining an eccentric axis, which is parallel to the main axis; a lever, which pivots in an oscillating way about an axis of the lever to operate said heald frame, the axis of the lever and the main axis being parallel; and a connecting rod, which comprises: a first articulation end, by means of which the connecting rod is coupled to the connecting piece so that the eccentric system and the connecting rod are pivotable relative to each other about the eccentric axis, the eccentric axis and the main axis being spaced apart by an eccentric center distance, and a second articulation end, by means of which the connecting rod is coupled to the lever, so that the lever and the connecting rod are pivotable relative to each other about a connecting rod axis, which is parallel to the main axis, the connecting rod axis and the eccentric axis being spaced apart by a connecting rod center distance.

According to the invention, the shedding machine comprises: an adjustment system, which comprises means for locking and which allows: at least one adjustment configuration, among: an amplitude adjustment configuration, in which the means for locking allows movement of the connecting piece relative to the base so that the eccentric center distance is adjustable, and a height adjustment configuration, in which the means for locking allows movement of the second articulation end relative to the first articulation end so that the connecting rod center distance is adjustable; and a locked configuration, in which the eccentric center distance and the connecting rod center distance are fixed, in that the means of locking is configured to make the connecting piece fixedly secured to the base and to make the first articulation end fixedly secured to the second articulation end; and a locking system, which allows for a locked configuration, in which the locking system locks the orientation of the lever, when the lever is in a reference orientation, and a releasing configuration, in which the locking system allows pivoting of the lever.

One idea behind the invention is to provide that, when the shedding machine is in an adjustment configuration and the locking system is in a locked configuration, a rotation of the eccentric system changes the reciprocating translation stroke adjustment of the heald frame, since the lever is locked in the reference orientation by the locking system. In particular, in the case where the adjustment system is in the amplitude adjustment configuration, the connecting rod center distance is fixed, so that a change in the orientation of the base of the eccentric system about the main axis corresponds to a change in the eccentric center distance when the lever is locked. In the case where the adjustment system is in a height adjustment configuration, the eccentric center distance is fixed, so that a change in the orientation of the eccentric system about the main axis corresponds to a change in the value of the connecting rod center distance when the lever is locked. Advantageously, the rotation of the eccentric system can be carried out by the rotary electric actuator, such that in the adjustment configuration, the adjustment can be carried out by having the rotary electric actuator execute a command to rotate the eccentric system, whether this command is transmitted on the order of an operator, or on the order of an automatic adjustment program. Once the lever has been locked in the reference orientation and the adjustment system has been put into the adjustment configuration, it is advantageously not necessary to manually move parts of the shedding machine to perform the adjustment, which reduces the risk of error, makes the adjustment less tedious, and allows for a particularly accurate adjustment. Alternatively, the rotation of the eccentric system can be carried out manually to perform the adjustment.

The invention applies to the case where the machine presents an amplitude adjustment configuration, in the case where the machine presents a height adjustment configuration, and in the case where the machine presents both an amplitude adjustment configuration and a height adjustment configuration. The invention applies to a shedding machine that comprises a shed height adjustment system, or a shed amplitude adjustment system, or both.

Preferably, the locking system comprises a stop, which, in order to lock the pivoting of the lever, cooperates mechanically with the lever, and, in order to allow the pivoting of the lever, is released from the lever.

Preferably, in order for the eccentric center distance to be adjustable when the adjustment system is in the amplitude adjustment configuration, the connecting piece and the base are pivotable relative to each other about a crank axis, which is fixed relative to the base and relative to the connecting piece and which is parallel to the main axis.

Preferably, the connecting piece comprises a crankpin, coaxial with the crank axis, and the base comprises a pinch ring receiving the crankpin, the base carrying the connecting piece by means of the crankpin received in the pinch ring.

Preferably, the base comprises a crankpin, coaxial with the crankshaft, and the connecting piece comprises a pinch ring receiving the crankpin, the base carrying the connecting piece by means of the crankpin received in the pinch ring.

Preferably, the locking means comprises a clamping screw, which: in the locked configuration of the adjustment system, is in a clamping position of the pinch ring around the crankpin, to secure the connecting piece to the base, and in the amplitude adjustment configuration of the adjustment system, is in a release position of the pinch ring around the crankpin, to allow the pivoting of the connecting piece with respect to the base, by pivoting the crankpin in the pinch ring.

Preferably, the base comprises a cam groove defining a spiral about the main axis, and the connecting piece comprises a finger-follower, which travels along the cam groove to guide the connecting piece relative to the base, when the adjustment system is in an amplitude adjustment configuration and thus varies the eccentric center distance.

Preferably, the eccentric system comprises: a flange, which extends perpendicular to the main axis, which comprises means for positioning the finger-follower in the cam groove, and an elongated oblong opening along a translational axis; and a rod, which is coaxial with the main axis and which is received in the oblong opening for supporting the flange by means of the elongated opening.

Preferably, the locking means comprises a clamping screw and a clamping nut, which form the rod, the clamping screw and the clamping nut being mutually threaded along the main axis. Preferably, in the locked configuration of the adjustment system, the flange is fixedly secured to the base, being axially clamped against the base, by screwing the clamping screw into the clamping nut, to immobilize the connecting piece along the spiral path relative to the base and thus fix the eccentric center distance. Preferably, in the amplitude adjustment configuration, movement of the connecting piece relative to the base is allowed, by loosening the clamping screw of the clamping nut.

Preferably, the connecting rod comprises a first connecting rod end, carrying the first articulation end, and a second connecting rod end, carrying the second articulation end, the first connecting rod end and the second connecting rod end being slidably fitted together along a sliding axis, so that the connecting rod center distance is adjustable.

Preferably, the adjustment system comprises adjustment stops, among: amplitude adjustment stops, limiting the movement of the connecting piece to limit the variation of the eccentric center distance between a predetermined minimum eccentric center distance value and a maximum eccentric center distance value, in the case where the adjustment system can be put in the amplitude adjustment configuration; and height adjustment stops, limiting the movement of the second articulation end to limit the variation of the connecting rod center distance between a predetermined minimum connecting rod center distance value and a predetermined maximum connecting rod center distance value, in the case where the adjustment system can be put in the height adjustment configuration.

Preferably, the adjustment system comprises at least a brake, from among: an amplitude adjustment brake configured to maintain the position of the connecting piece relative to the base, below the application of a specific relative displacement force while the adjustment system is in the amplitude adjustment configuration; and a height adjustment brake configured to maintain the position of the second articulation end relative to the first articulation end below the application of a specific relative displacement force while the adjustment system is in the height adjustment configuration.

Preferably, the adjustment system comprises at least one set of graduations, among: a set of amplitude adjustment graduations, indicating an amplitude adjustment value depending on the eccentric center distance; and a set of height adjustment graduations, indicating an amplitude adjustment value depending on the connecting rod center distance.

Preferably, the controller is able to control the rotary electric actuator to vary the eccentric center distance in the amplitude adjustment configuration or to vary the connecting rod center distance in the height adjustment configuration.

The invention also has as its object a loom, comprising the shedding machine as defined above, and the heald frame operated by the shedding machine.

The invention also has as its object an adjusting method, for adjusting the shedding machine as defined above. The adjusting method comprises successively: a step of pivoting the lever to the reference orientation, by rotating the eccentric system while the adjustment system is in the locked configuration and that the locking system is in the release configuration; a step of putting the locking system into the locked configuration; a step of putting the adjustment system into the adjustment configuration; and, in the case where the adjustment system is in the amplitude adjustment configuration, a step of adjusting the eccentric center distance by rotating the eccentric system by a predetermined value and, in the case where the adjustment system is in the height adjustment configuration, a step of adjusting the connecting rod center distance by rotating the eccentric system by a predetermined value.

Preferably, for the adjustment step, the rotation of the eccentric system is performed by a rotation command of the rotary electric actuator.

Preferably, the rotary electric actuator is rotationally controlled according to a target value or incremental value setpoint relative to a desired frame stroke or a desired frame height.

Preferably, the adjusting method comprises a prechecking step, carried out after the step of setting the adjustment system to the adjustment configuration and before the adjustment step, the prechecking step comprising: a step of operating the rotary electric actuator in a first rotational direction until an adjustment stop is reached; a step of measuring a first rotational angle described by the eccentric system having reached the adjustment stop; a step of comparing the measured first angle of rotation with a predetermined first angle corresponding to the predicted rotation based on the position of the adjustment stop to establish whether the shedding machine is in a nominal situation or in a fault situation, such as a loosening fault or an adjustment fault; and a step of issuing an alarm, in case it has been established that the shedding machine is in the fault situation.

Preferably, the prechecking control comprises, prior to the step of transmitting the first set point: a step of rotational control by the rotary electric actuator in a direction of rotation, opposite to the first direction of rotation, until reaching an adjustment stop; a step of measuring a second angle of rotation described by the eccentric system having reached the adjustment stop; and a step of comparing the measured second angle of rotation with a predetermined second angle corresponding to the predicted rotation based on the position of the stop, to establish whether the shedding machine is in a nominal situation or in a fault situation, such as a loosening fault or an adjustment fault.

Preferably, after the adjustment step, the adjusting method comprises, in sequence: a step of implementing the adjusting system to a locked configuration; and a step of implementing the locking system to a released configuration.

Preferably, the adjusting method comprises a locking check step between the step of implementing the locking system in the locked configuration and the step of implementing the adjustment system in the adjustment configuration, which comprises: a step of checking that the rotary actuator does not rotate under the application of a predetermined torque value, and a step of issuing an alarm signaling a locking fault in the event that a rotational movement of the rotary electric actuator is detected.

Preferably, the adjusting method comprises a locking check step, between the locked configuration step and the released configuration step, which comprises: a step of checking that the rotary electric actuator does not rotate under the application of a predetermined torque value, and a step of issuing an alarm indicating a locking failure in the event that a rotational movement of the rotary electric actuator is detected.

Preferably, the adjusting method comprises turning off a power supply to the rotary electric actuator during the step of implementing the adjustment configuration.

DESCRIPTION OF THE DRAWINGS

The invention and other advantages thereof will become more apparent from the following description of embodiments in accordance with the invention, given by way of example only and made with reference to the drawings below in which.

DESCRIPTION

Figure 1:
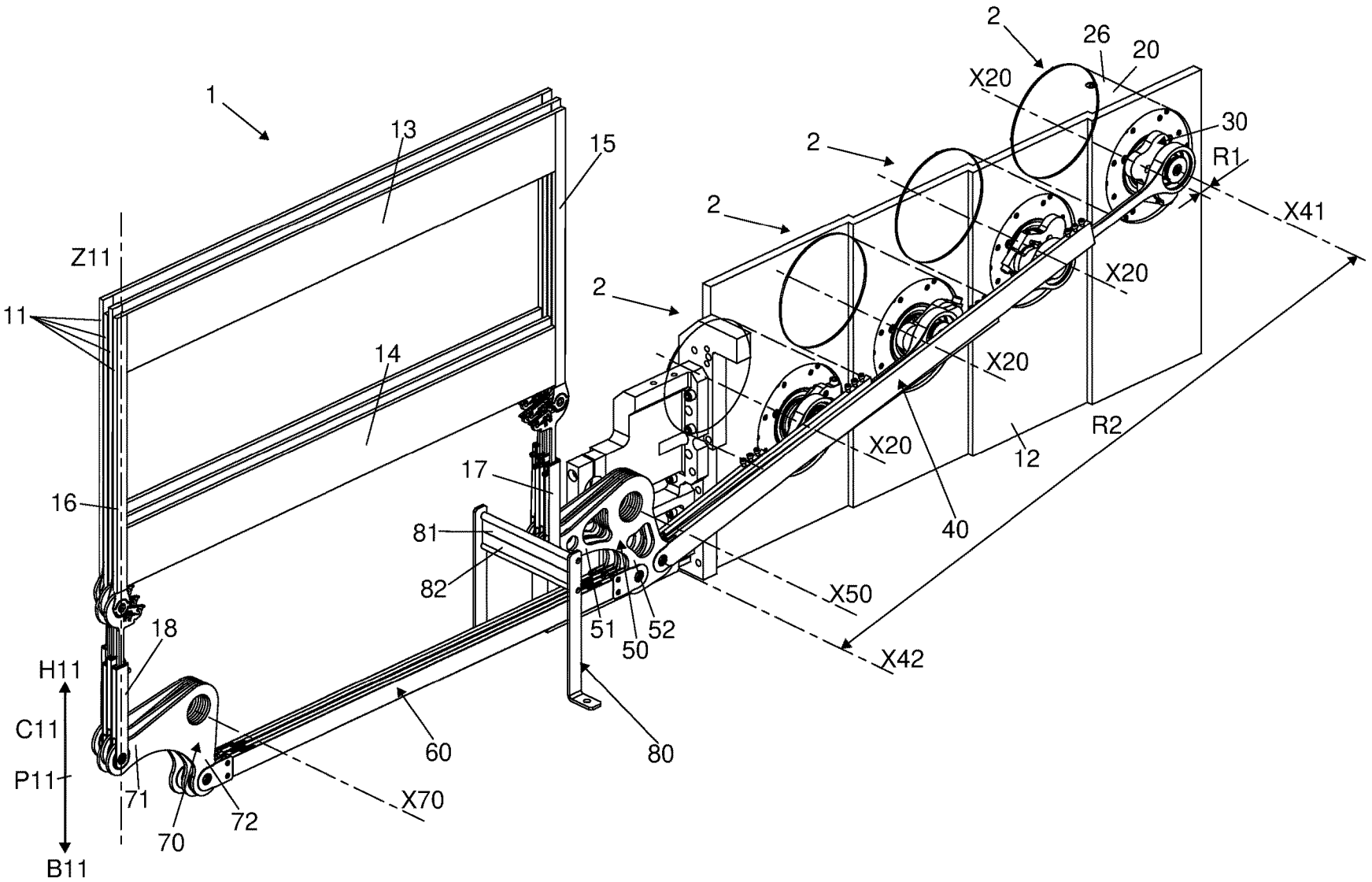
FIG. 1 is a partial perspective view of a loom equipped with four shedding machines, according to a first embodiment of the invention.

FIG. 1 shows a first embodiment, including a loom 1 with heald frames 11, a frame 12 and shedding machines 2 for operating the heald frames 11. In FIG. 1, the heald frames 11 are shown in a reduced scale vis-à-vis the machines 2.

Here, four heald frames 11 and four machines 2 are provided, each machine 2 operating one of the frames 11 respectively.

As a variant, a number of frames 11 other than four is provided. Alternatively, a number of machines 2 other than four is provided. Alternatively, a single machine 2 may be provided that operates several heald frames 11.

Advantageously, each heald frame 11 comprises an upper crossbeam 13, a lower crossbeam 14, parallel to the crossbeam 13 and two uprights 15 and 16, parallel to each other and connecting the crossbeams 13 and 14. Preferably, the crossbeams 13 and 14 are horizontal while the uprights 15 and 16 are vertical. Each heald frame 11 is equipped with a row of healds, not shown, each connecting the crossbeams 13 and 14 and being arranged between the uprights 15 and 16, being distributed along the crossbeams 13 and 14. The healds each carry an eyelet through which a warp thread passes, the warp threads forming a warp thread sheet. The loom 1 advantageously includes other components, such as a sley, weft thread insertion means, which are not shown.

For the purpose of weaving, each machine 2 is designed to actuate the corresponding heald frame 11 according to a reciprocating translation stroke C11, relative to the frame 12, along a frame axis Z11 specific to this frame 11. The term "stroke" refers to the distance covered by the heald frame 11 during its movement. FIG. 1 shows the stroke C11 for the heald frame 11 located in the foreground of FIG. 1. Being moved by the machine 2 along the stroke C11, the heald frame 11 is moved parallel to the axis Z11, according to a rectilinear movement, by going back and forth between a high extreme position H11, corresponding to an upper limit of the stroke C11, and a low extreme position B11, corresponding to a lower limit of the stroke C11. The axis Z11, and therefore the movement of the heald frame 11, is preferably vertical, or at least parallel to the healds of the heald frame 11 considered.

During weaving, for the insertion of each weft thread, the position of the heald frames 11 along their respective stroke C11 is determined under the action of the machines 2, independently for each heald frame 11, to define the shed of the loom receiving the inserted weft thread. The loom 1 then produces a fabric of warp and weft threads with a desired weave.

Each shedding machine 2 comprises a rotary electric actuator 20, and a pulling mechanism comprising an eccentric system 30, a connecting rod 40, so-called "transmission rod", a lever 50 and, preferably, a connecting rod 60, a lever 70, a connecting rod 17 and a connecting rod 18. The loom 1 comprises a locking system 80, which is shared between the machines 2.

For each shedding machine 2, the each heald frame 11 is operated by said shedding machine 2 by being operated by the electric actuator 20 of that shedding machine 2, by means of the pulling mechanism of that shedding machine 2, connecting the actuator 20 to the heald frame 11.

The actuators 20 are advantageously identical, arranged side by side in the same orientation. The actuators 20 are advantageously arranged next to the heald frames 11, on the side of the lever 50. Each rotary electric actuator 20 is an electric motor, which comprises a stator 26, fixed relative to the frame 12, and a rotor driving an output shaft 28 of the actuator 20.

In the present example, the stator 26 includes a housing, which comprises a circular-based cylindrical wall centered on an axis X20, referred to as the "main axis," and a mounting plate 73 perpendicular to the axis X20, closing a front end of the cylindrical wall and serving to securely attach the stator 26 to the frame 12. The rotor, not visible in the figures, is supported by the stator 26 so as to be pivotable about the axis X20 relative to the stator 26. The rotor is coaxial with the axis X20 and is contained within the stator 26. The output shaft 28 is here directly formed at a front end of the rotor and passes through the mounting plate to open to the outside. When the actuator 20 is appropriately electrically powered by a power circuit 21 belonging to the loom 1, the output shaft 28 is driven in rotation about the axis X20 by the rotor. In other words, in order to electrically power the rotor and/or stator 26 and control the actuator 20, the actuator 20 is electrically connected to the power circuit 21.

Alternatively, it can be anticipated that the rotor and the output shaft are separate elements and non-coaxial with the actuator 20, the rotor driving the output shaft through a gearbox, the main axis X20 about which the output shaft rotates being parallel to the axis of rotation of the rotor.

For each actuator 20, the axis X20 is perpendicular to the axis Z11. For each actuator 20, the main axis X20 is advantageously perpendicular to a plane defined by the heald frame 11. The heald frames 11 are distributed parallel to the axis X20 of the actuators 20. Each pulling mechanism is advantageously coplanar with the heald frame 11 that it actuates. The actuators 20 are themselves slightly offset from each other parallel to the axis X20, so that their output shaft 28 lies in the plane of the heald frame 11 and the pulling mechanism it actuates. As the heald frames 11 and the pulling mechanisms are distributed along parallel planes, they do not hinder each other in their movements.

Concerning the actuators 20, other configurations are possible. For example, the actuators 20 can be distributed according to a vertical column, distributed on both sides of the frames 11, and/or mounted head to tail, for accessibility or space requirements of the loom 1.

Preferably, during weaving, the actuator 20 performs a continuous rotation, in other words, a rotation without changing direction, and not an oscillating movement.

As shown in FIG. 1, for each pulling mechanism, the lever 50 pivots in an oscillating way relative to the frame 12 about an axis X50, the so-called "lever axis", parallel to the main axis X20. The lever 50 is advantageously coplanar with the heald frame 11 to be actuated. The lever 50 is connected to the heald frame 11 to be actuated, by means of the connecting rod 17. For this purpose, the connecting rod 17 is coupled to a radial arm 51, here approximately horizontal, belonging to the lever 50, by an articulation end allowing a pivoting of the connecting rod 17 relative to the lever 50 about an axis parallel to the axis X50, and is coupled to the heald frame 11, by an articulation end allowing a pivoting of the connecting rod 17 relative to the heald frame 11 about an axis parallel to the axis X50. The articulation end of the connecting rod 17 with the frame is arranged on the side of the upright 15, at the bottom of the heald frame 11, here at the intersection between the upright 15 and the crossbeam 14. The two articulations of the connecting rod 17 are approximately parallel to the axis Z11. By means of the connecting rod 17, the oscillating pivoting of the lever 50 actuates and determines the oscillating translation of the heald frame 11 along the stroke C11.

At any time, the orientation of the lever 50 relative to the frame 12 corresponds to a single position of the heald frame 11 along the stroke C11. During its oscillating pivoting, the lever 50 pivots in a first direction to a maximum orientation, where the heald frame 11 is in the extreme high position H11, and then in a second opposite direction to a minimum orientation, where the heald frame 11 is in the extreme low position B11. In moving from the maximum orientation to the minimum orientation and back again, the lever 50 moves the heald frame 11 through the entire stroke C11.

Also, if provided, the lever 70 is pivotable in oscillation relative to the frame 12, about an axis X70, called "lever axis", parallel to the main axis X20. The lever 70 is advantageously coplanar with the heald frame 11 to be actuated. The lever 70 is connected to the heald frame 11 to be actuated, by means of the connecting rod 18. For this purpose, the connecting rod 18 is coupled to a radial arm 71, here approximately horizontal, belonging to the lever 70, by one articulation end allowing a pivoting of the connecting rod 18 relative to the lever 70 about an axis parallel to the axis X70, and is coupled to the heald frame 11, by one articulation end allowing a pivoting of the connecting rod 18 relative to the heald frame 11 about an axis parallel to the axis X70. The articulation end of the connecting rod 17 with the heald frame 11 is arranged on the side of the upright 16, at the bottom of the heald frame 11, here at the intersection between the upright 16 and the crossbeam 14. The two articulations of the connecting rod 18 are approximately parallel to the axis Z11. The connecting rods 17 and 18 are advantageously parallel. By means of the connecting rod 18, the pivoting oscillation of the lever 70 actuates and determines the reciprocating translation of the heald frame 11 along the stroke C11.

The levers 50 and 70 are synchronized in their pivoting oscillation, so as to be in the same orientation relative to the frame 12, about their respective axes X50 and X70. For this purpose, as shown in FIG. 1, the connecting rod 60 is coupled to a radial arm 52 of the lever 50, here a vertical arm, by an articulation end allowing a pivoting of the connecting rod 60 relative to the lever 50 about an axis parallel to the axis X50, and to a radial arm 72, here a vertical arm, of the lever 70, by an articulation end allowing a pivoting of the connecting rod relative to the lever 70 about an axis parallel to the axis X70. The connecting rod 60 is approximately parallel to the crossbeams 13 and 14 of the heald frame 11. The arms 51 and 52 are preferably perpendicular, so that the lever 50 presents a general L-shape. The arms 71 and 72 are preferably perpendicular, so that lever 70 presents a general L-shape. An actuation of lever 50 in oscillation about axis X50 results in a synchronous actuation of lever 70 in oscillation about axis X70, by means of the connecting rod 60, which results in the actuation of the heald frame 11 in reciprocating translation by both levers 50 and 70 at the same time, by means of the connecting rods 17 and 18.

The eccentric system 30 comprises a base 31 and a connecting piece 32.

Along the axis X20, the base 31 is preferably arranged between the actuator 20 and the connecting piece 32. The base 31 is fixed on the output shaft 28 of the actuator 20, so as to be directly driven in rotation about the axis X20 by the actuator 20, relative to the frame 12. The axis X20 is fixed relative to the frame 12 and relative to the base 31. The orientation of the output shaft 28 about the axis X20 corresponds to that of the base 31. By means of the base 31, the entire eccentric system 30 is rotated by the actuator 20 about the axis X20. Conversely, the rotation of the eccentric system 30 about the axis X20 drives the rotor about the axis X20.

The lever 50 is driven according to the pivoting oscillation, that is, with change of direction, by the continuous rotation of the eccentric system 30, that is, without change of direction, by means of the transmission rod 40. The transmission rod 40 converts the continuous rotation of the eccentric system 30 into a pivoting oscillation of the lever 50. For this purpose, the transmission rod 40 comprises, at a first end, an articulation end 41, and, at a second end, an articulation end 42.

The transmission rod 40 is coupled to the connecting piece 32 of the eccentric system 30 by means of the articulation end 41. By means of this articulation end 41, the transmission rod 40 and the connecting piece 32 are pivotable relative to each other about an axis X41, the so-called "eccentric axis". The axis X41 is fixed relative to the transmission rod 40 and relative to the connecting piece 32 and is parallel to the axis X20. The axes X41 and X20 are spaced apart from each other by a distance R1, which is a distance measuring the center distance between the axes X41 and X20. This distance R1 is referred to as the "eccentric center distance". As the eccentric system 30 rotates about the X20 axis, the X41 axis rotates about the X20 axis.

In the present example, the articulation end 41 comprises a circular flange centered on the axis X41 and which receives within it a crankpin 35 belonging to the connecting piece 32, the crankpin 35 being pivotally supported within the flange, by means of a bearing 43, here a rolling element bearing, centered on the axis X41.

By means of the articulation end 42, the transmission rod 40 is coupled to the arm 52 of the lever 50. As a variant, the transmission rod 40 is attached to another arm of the lever 50, which is separate from the arms 51 and 52. In any case, by means of this articulation end 41, the transmission rod 40 and the lever 50 are pivotable relative to each other about an axis X42, called the "connecting rod axis". The axis X42 is fixed relative to the transmission rod 40 and relative to the lever 50. The axes X42 and X50 are parallel and distant from each other, so that the arm 52 to which the articulation end 42 is connected serves as the lever arm for actuation of the lever 50 by the transmission rod 40. When the transmission rod 40 is driven by the eccentric system 30, the axis X42 rotates about the axis X50. The axis X42 is also parallel to and spaced apart from axis X20. The axes X41 and X42 are parallel and spaced apart from each other by a distance R2, which is a distance measuring the center-to-center distance between the axes X41 and X42. This distance R2 is referred to as the "connecting rod center distance".

In the present example, the articulation end 42 comprises two parallel flanges arranged on either side of the lever 50. These two flanges of the end 42, as well as the arm 52 of the lever 50 being crossed by an opening coaxially with the axis X42, within which is received a rivet, not shown, to couple the lever 50 and the transmission rod 40 while allowing their relative pivoting.

Each shedding machine 2 comprises an adjustment system, which allows for a locked configuration and one or more adjustment configurations. In the locked configuration, the center-to-center distances R1 and R2 are fixed. To perform a weaving operation, it is ensured that the adjustment system is in the locked configuration. In the locked configuration of the adjustment system and in the weaving operation of the loom, the center distances R1 and R2 cannot be changed. For each adjustment configuration, one of the center distances R1 and R2 is variable so that it can be adjusted, while the other center distance R1 or R2 is fixed. Here, the adjusting system allows for alternating movement between the locked configuration, an amplitude adjustment configuration where the eccentric center distance R1 is variable while the connecting rod center distance R2 is fixed, and a height adjustment configuration where the distance R2 is variable while the distance R1 is fixed. Alternatively, it could be anticipated that the adjustment system only evolves between the locked configuration and one of the adjustment configurations, for example the height adjustment configuration.

Due to the structure of the pulling mechanism, changing the eccentric center distance R1 correspondingly changes the amplitude of the stroke C11, in other words, the distance between the extreme high position H11 and the extreme low position B11 taken by the heald frame 11 when it is driven under the action of the actuator 20 while the adjusting system is in the locked configuration. In the present case, the greater the distance R1, the greater the amplitude of the stroke C11, in other words, the greater the distance between positions B11 and H11. Changing the eccentric center distance R1 therefore allows the amplitude of the shed opening controlled by the heald frame 11 to be changed. For example, it is provided that the distance R1 can be varied from a minimum value of 20 mm (millimeters) to a maximum value of 60 mm, to vary the amplitude of the stroke C11 from a minimum value of 50 mm to a maximum value of 160 mm, when the height of the stroke C11 is centered on a reference position P11, in other words, with the positions B11 and H11 equidistant from the position P11. The reference position P11 is defined as a central position, which may correspond to the crossing position of the loom 1 for all the yarn sheets.

Due to the structure of the pulling mechanism, changing the connecting rod center distance R2 correspondingly changes the height of the stroke C11 relative to the frame 12, in other words, the height of the stroke C11 relative to the reference position P11 of the heald frame 11 relative to the frame 12 along the axis Z11, shown in FIG. 1. In particular, increasing the connecting rod center distance R2 shifts both the end position H11 and the end position B11 upwards relative to the position P11. Conversely, reducing the connecting rod center distance R2 shifts both the end position H11 and the end position B11 downwards relative to position P11. Preferably, changing the distance R2 does not change the amplitude of the stroke C11, in other words, does not change the distance between positions B11 and H11. Changing the connecting rod center distance R2 therefore allows the shed crossing to be changed by adjusting the opening height of the shed controlled by the heald frame 11. For example, it is anticipated that the distance R2 can be varied from −6 mm to +6 mm relative to a central value, corresponding to a shift in height of the stroke C11 from −8 mm to +8 mm relative to the reference position P11.

Figure 2:
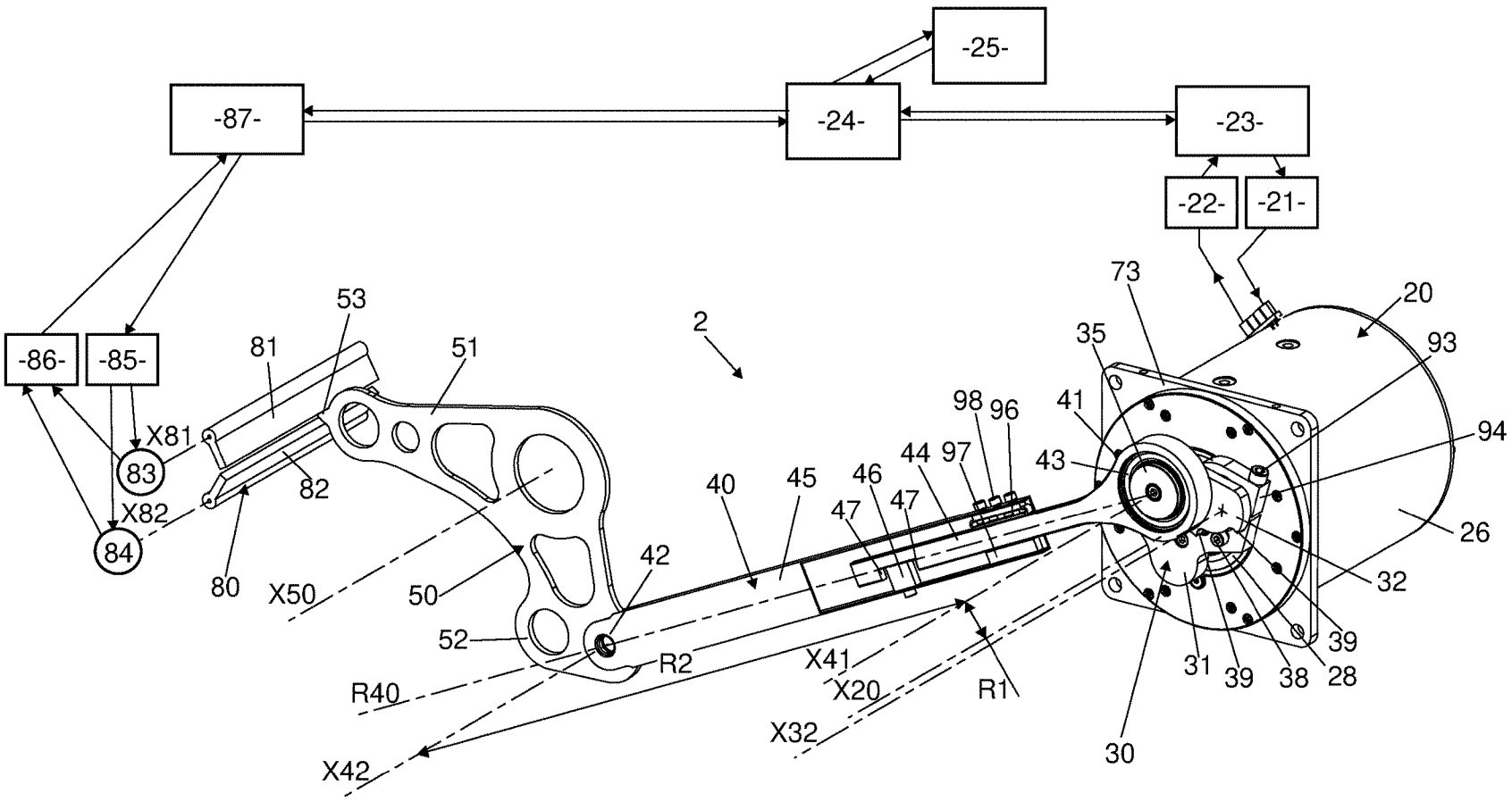
FIG. 2 is a perspective view, from another angle, of one of the shedding machines of FIG. 1.
Figure 4:
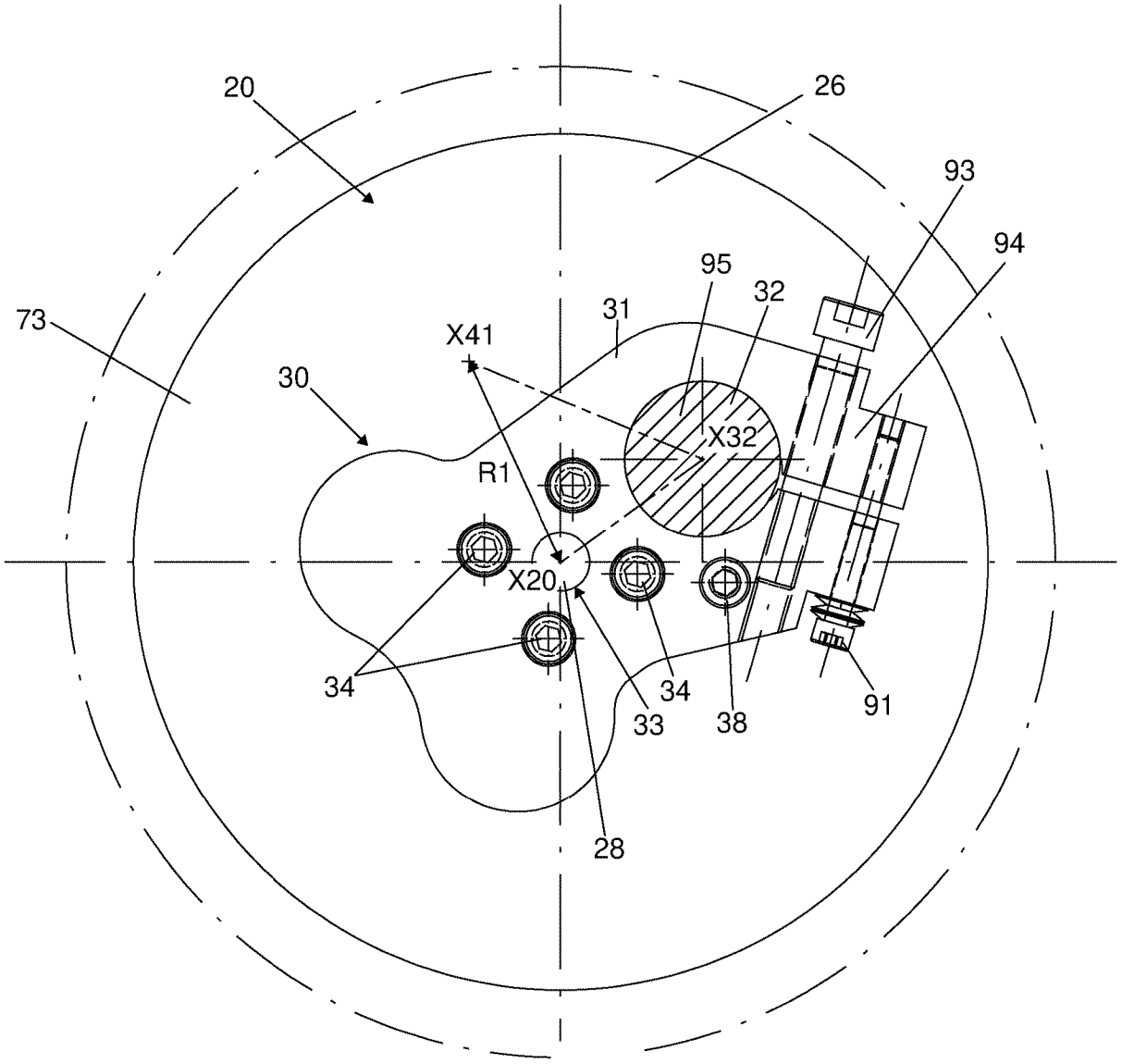
FIG. 4 is a front view of an actuator and eccentric system belonging to the shedding machine of FIGS. 2 and 3, where a connecting piece belonging to the eccentric system is shown cut in a vertical plane.
Figure 6:
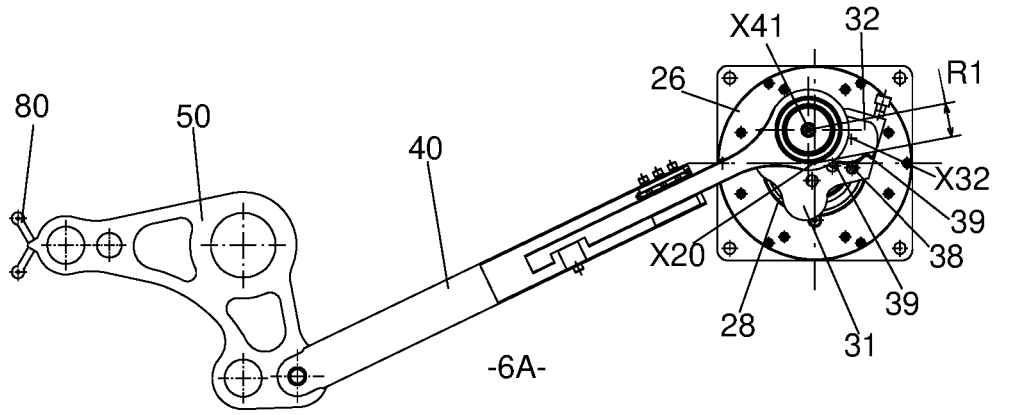
FIG. 6 shows several side views of the shedding machine of FIGS. 2 to 5, shown in the amplitude adjustment configuration.
Figure 6:
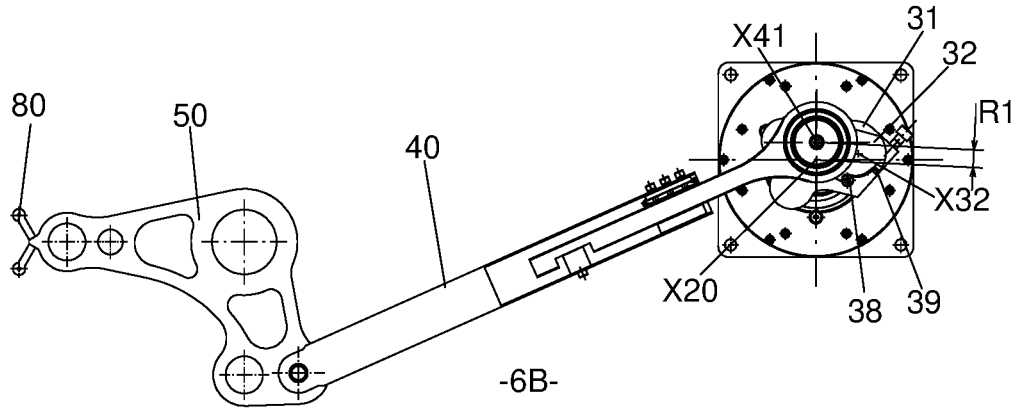
Figure 6:
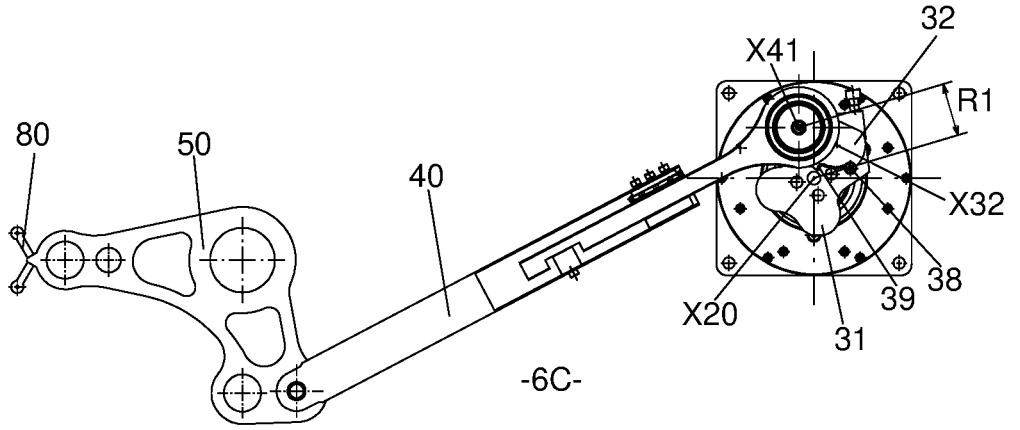

As illustrated in FIGS. 2, 4 and 6, so that the eccentric center distance R1 can be variable, the geometry of the eccentric system 30 is modulable, and in particular the connecting piece 32 is made movable relative to the base 31. The adjusting system comprises locking means for selectively allowing this mobility, to obtain the amplitude adjustment configuration, and prohibiting this mobility, to obtain the locked configuration or the height adjustment configuration.

In the present example, in order for the eccentric center distance R1 to be adjustable when the adjustment system is in the amplitude adjustment configuration, the connecting piece 32 and the base 31 are pivotable relative to each other about an axis X32, referred to as the "crank axis." The axis X32 is fixed relative to the base 31 and relative to the connecting piece 32 and is parallel to the axis X20. The axes X41 and X32 are not coaxial. When the connecting piece 32 is pivoted relative to the base 31 about the axis X32, the axis X41 is moved relative to the axis X20 according to a circular path centered on the axis X32, thereby varying the distance R1, as shown in FIG. 6. In this sense, the connecting piece 32 constitutes a crank relative to the base 31.

In the example, as best seen in FIG. 4, the base 31 is constituted by a piece that is generally flat in a plane perpendicular to the axis X20. The base 31 includes a main opening 33, receiving the output shaft 28 of the actuator 20 so that the base 31 is fixedly secured to this shaft. Several fasteners are also provided, in this case four screws 34, distributed about the axis X20, to ensure that the base 31 is rotationally fixedly secured to the output shaft 28 and/or with the rotor of the actuator 20.

The base 31 also includes a pinch ring 94, with two jaws radially surrounding the crank axis X32. The connecting piece 32 forms a crankpin 95, visible in FIG. 4, which is received within the pinch ring 94. The crankpin 95 presents in the form of a circular-based cylindrical member, centered on the axis X32, and received within the jaws of the pinch ring 94, which is complementary in shape. The crankpin 95 projects in the opposite direction from the crankpin 35 received in the articulation end 41 and is offset relative to the latter. A clamping of the pinch ring 94 around the crankpin 95 is ensured by a clamping screw 93, the head of which rests on one of the jaws of the pinch ring 94, the body of which passes through this jaw and is screwed into a thread of the other jaw. The screw 93 is advantageously directed in an orthoradial direction relative to the axis X32, in other words, a direction perpendicular to a radius from the axis X32, and in a plane orthogonal to the axis X32. A tightening of the screw 93 tends to bring the jaws closer to each other, which causes centripetal clamping forces to be applied to the pinch ring 94 on the crankpin 95, resulting in a tightening torque. The base 31 carries the connecting piece 32 by means of its crankpin 95, in that the crankpin 95 is received in the pinch ring 94.

The pinch ring 94, the crankpin 95 and the screw 93 belong to the locking means of the adjustment system. Indeed, the piece 32 and the base 31 can be fixedly secured relative to one another by putting the screw 93 in a position of tightening the pinch ring 94 around the crankpin 95. In the clamping position, the screw 93 clamps the pinch ring 94 around the crankpin 95 so as to apply a sufficiently high tightening torque so that, during weaving, the piece 32 remains immobile relative to the base 31. In the locked configuration, the screw 93 is therefore placed in the clamping position. In the amplitude adjustment configuration, the screw 93 is placed in a position of loosening the pinch ring 94 about the crankpin 95, so that the pinch ring 94 and the crankpin 95 form a pivot connection, allowing and guiding the pivoting of the piece 32 relative to the base 31 about the axis X32.

Preferably, the adjustment system comprises braking means, in particular an amplitude adjustment brake. This amplitude adjustment brake ensures that, in the loosening position of the screw 93, the tightening torque exerted by the pinch ring 94 on the crankpin 95 is non-zero, so as to constitute a braking torque, which, while allowing the pivoting of the connecting piece 32 relative to the base 31, resists this pivoting. More generally, while the adjustment system is in the amplitude adjustment configuration, the amplitude adjustment brake allows the connecting piece 32 to move relative to the base 31, but nevertheless brakes that movement by applying a braking torque and/or force. This prevents the adjustment system, when placed in the amplitude adjustment configuration, from changing the distance R1 at the outset under the weight of the machine parts. This reduces the need for the actuator 20 to be equipped with a motor brake, which is economically advantageous. The braking torque provides a force below the application of a specific relative displacement force, such that the amplitude adjustment brake is configured to maintain the position of the connecting piece 32 relative to the base 31 below the application of a specific relative displacement force while the adjustment system is in an amplitude adjustment configuration. This specific relative displacement force can be calculated based on the weight of the parts, the frame and the pulling mechanism, the lever arms or the friction between parts. The actuator is able to exceed this relative displacement force to rotate the base 31 and perform the adjustment.

In this case, the amplitude adjustment brake, shown only in FIG. 4, comprises a braking screw 91. To obtain the braking torque, a slight tightening of the pinch ring 94 around the crankpin 95 is ensured by the tightening screw 91, the head of which presses on one of the jaws of the pinch ring 94, optionally by means of the intermediary of a set of Belleville-type spring washers. The body of the screw 91 passes through this jaw and is screwed into the other jaw. The screw 91 extends, for example, parallel to the screw 93, being oriented head to tail. Thus, the screw 91 is advantageously directed in a direction orthoradial to the axis X32. To adjust the intensity of the braking torque, the screw 91 is screwed in or out.

FIG. 6 shows a case 6A corresponding to an intermediate amplitude adjustment configuration, where connecting piece 32 is oriented so that the distance R1 takes on an intermediate eccentric center distance value, a case 6B corresponding to a minimum amplitude adjustment configuration where connecting piece 32 is oriented so that the distance R1 takes on a minimum center distance value, and a case 6C corresponding to a maximum amplitude adjustment configuration where connecting piece 32 is oriented so that the distance R1 takes on a maximum center distance value. Preferably, the adjustment system comprises amplitude adjustment stops, to limit the movement, in other words, in this case the pivoting, of the connecting part 32 relative to the base 31, about the axis X32, between the position shown in case 6B where the distance R1 takes the minimum eccentric center distance value and the position shown in case 6C where the distance R1 takes the maximum eccentric center distance value. Thus, the movement of the connecting piece 32 is only between these two positions, without going beyond. For example, to form the amplitude adjustment stops, the base 31 carries a stop screw 38, which is screwed into the base 31 parallel to the axis X20, so that a head of the screw 38 projects on the surface of the base 31 on the side of the connecting piece 32. Instead of the screw 38, any projecting part suitable for use as a stop can be provided. To form the amplitude adjustment stops, the connecting piece 32 includes two shoulders 39, which frame the stop screw 38. As shown in FIG. 6 for cases 6B and 6C, the screw 38 alternately abuts against one and the other of the shoulders 39, so that the pivotal travel of the connecting piece 32 is limited. As shown in FIG. 6 for case 6A, the screw 38 moves freely between the shoulders 39 to obtain the intermediate values of the distance R1.

Figure 3:
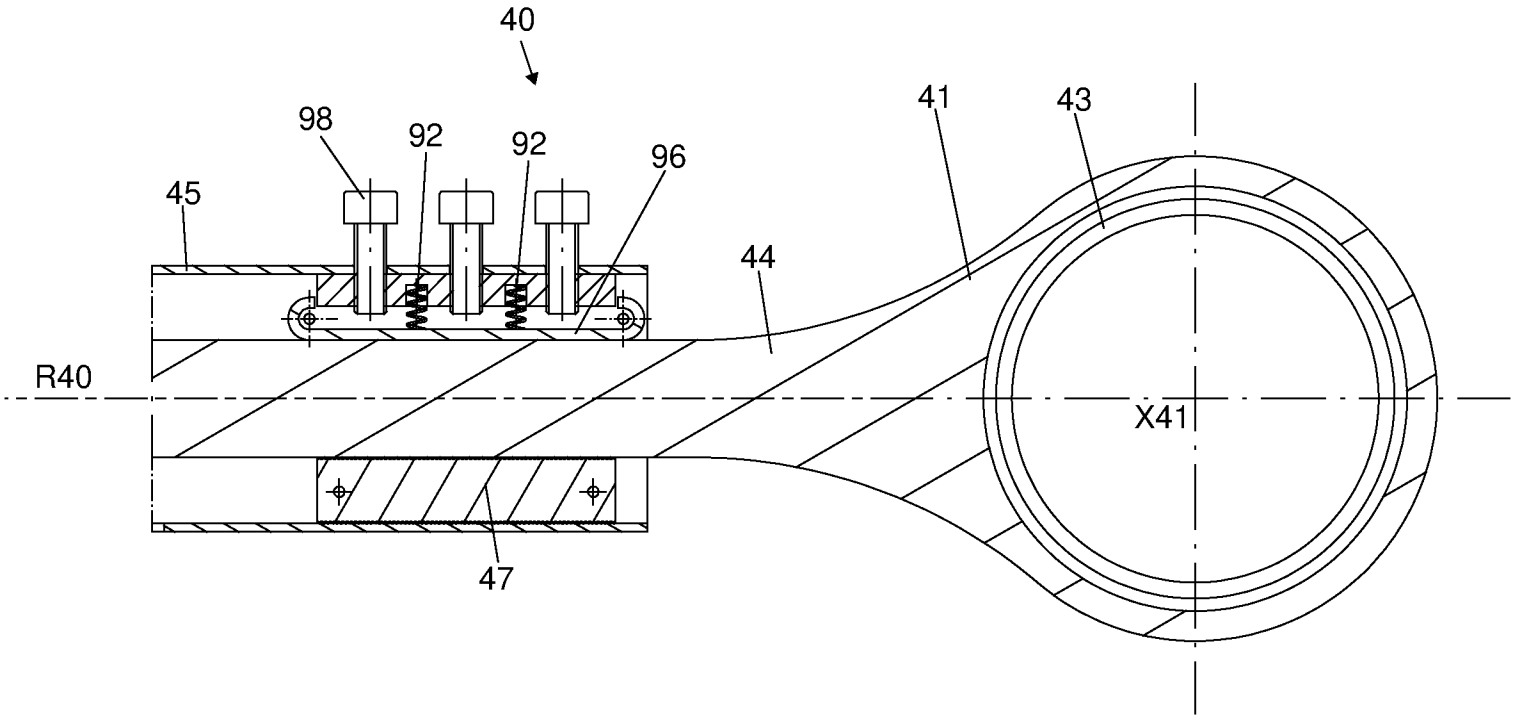
FIG. 3 is a partial longitudinal section of a connecting rod belonging to the machine of FIG. 2.
Figure 7:
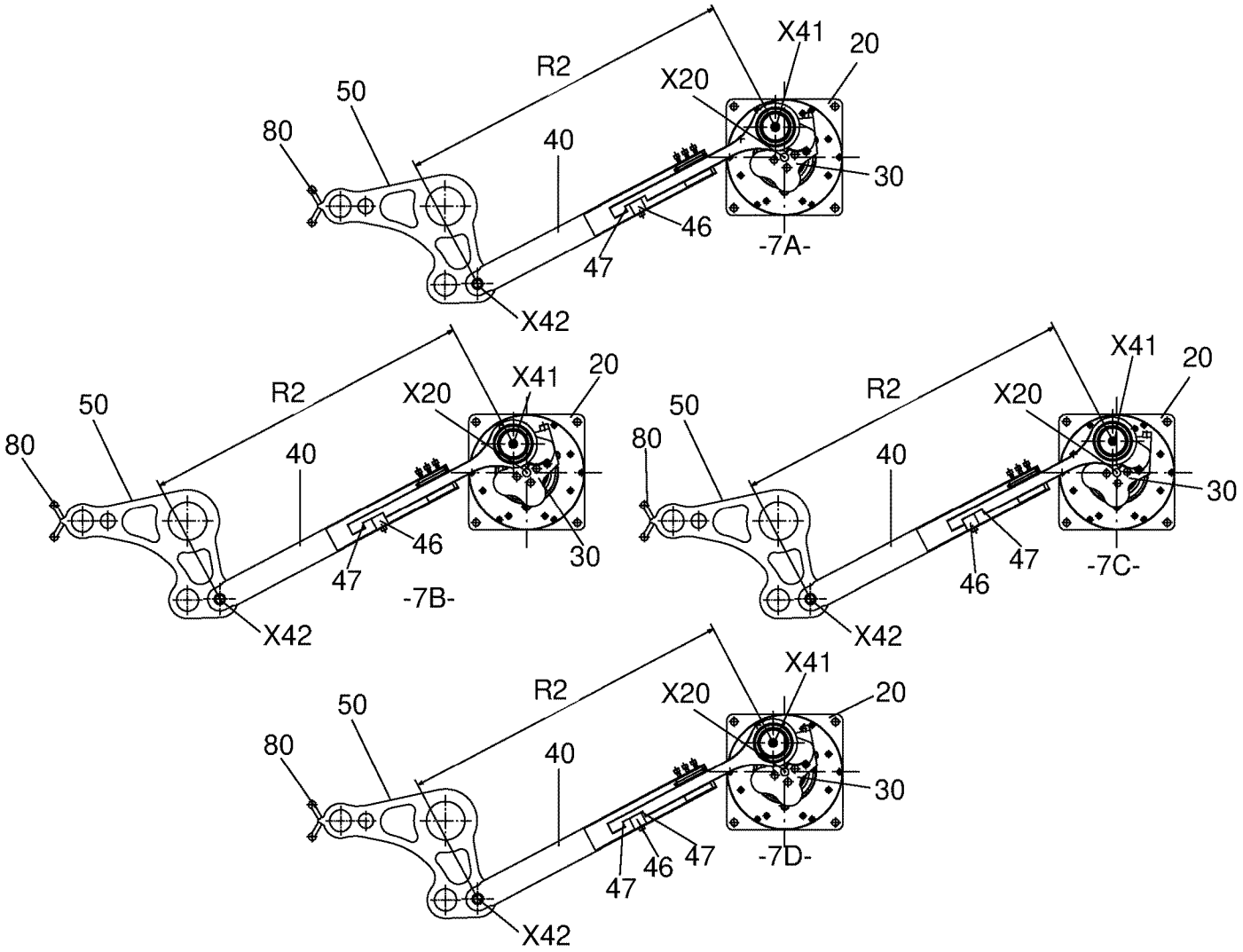
FIG. 7 shows several side views of the shedding machine of FIGS. 2 to 6, shown in the height adjustment configuration.

As shown in FIGS. 3 and 7, in order to allow the connecting rod center distance R2 to be variable, the articulation ends 41 and 42 of the transmission rod are movable relative to each other. The adjustment system comprises locking means for selectively allowing this mobility, to achieve the height adjustment configuration, and prohibiting this mobility, to achieve the locked configuration or the amplitude adjustment configuration.

In the present example, in order for the connecting rod center distance R2 to be adjustable when the adjustment system is in the height adjustment configuration, the articulation ends 41 and 42 slide relative to each other along a sliding axis R40 intersecting the axes X41 and X42, or at least parallel to the transmission rod 40. For example, the transmission rod 40 comprises a transmission rod end 44, carrying the articulation end 41, and a transmission rod end sleeve 45, carrying the end 42, the end 44 being slidably fitted into the transmission rod end sleeve 45, which presents the form of a sleeve to receive the transmission rod end 44, in the form of a rod, and guide its sliding along the axis R40.

To form the locking means of the adjustment system, it is provided, for example, that the transmission rod 40 comprises a bracket 96, a shoe 97 and at least one clamping screw 98, here three. The head of the screw 98 is accessible from the exterior of the transmission rod 40. The bracket 96 and the shoe 97 are arranged inside the transmission rod end sleeve 45 and together constitute a clamp for locking the transmission rod end 44. The bracket 96 and the shoe 97 are arranged in a pincer-like manner on either side of the transmission rod end 44. The shoe 97 is fixed relative to the transmission rod end sleeve 45 and is interposed between a wall of the sleeve and the stem of the transmission rod end 44. The bracket 96 is arranged between the other wall of the sleeve and the stem of the transmission rod end 44, being translationally movable along a direction perpendicular to the axis R40, between a clamped position, where the stem of the transmission rod end 44 is clamped between the bracket 96 and the shoe 97, so that the transmission rod end 44 is immobilized along the axis R40 relative to the transmission rod end 45, and a released position, where the stem of the transmission rod end 44 is sufficiently loosened to be able to slide. Screwing in the clamping screws 98 moves the bracket 96 to the clamped position. Loosening the clamping screws 98 allows the bracket to return to its loosened position.

Preferably, the braking means of the adjusting system comprises a height adjustment brake. This height adjustment brake ensures that, even in the released position of the locking means of the transmission rod 40, the clamping force applied by the bracket 96 on the rod of the transmission rod end 44 is not zero, so as to constitute a braking force. This braking force, while allowing the ends 41 and 42 to slide relative to each other, resists this sliding. More generally, while the adjustment system is in a height adjustment configuration, the height adjustment brake allows relative movement of the ends 41 and 42, but nevertheless brakes this movement by applying a torque and/or braking force. This prevents the distance setting R2 from being changed at the outset under the weight of the machine parts when the adjustment system is placed in the height adjustment configuration. This reduces the need for the actuator 20 to be equipped with a motor brake, which is economically advantageous. The braking torque provides a force below the application of a specific relative displacement force, such that the height adjustment brake is configured to maintain the position of the second articulation end 42 relative to the first articulation end 41 below the application of a specific relative displacement force while the adjustment system is in a height adjustment configuration. This specific relative displacement force may be calculated as a function of the weight of the parts, the frame and the pulling mechanism, the lever arms or the friction between parts. The actuator is capable of exceeding this relative displacement force to cause a relative displacement of the ends 41 and 41 and achieve the adjustment.

In this present case, the height adjustment brake, visible only in FIG. 3, comprises at least one spring 92, in this case two. To achieve the braking force, a slight tightening of the bracket 96 on the transmission rod end 44 is provided by elastic compression of the springs 92 even when the screws 98 are loosened.

FIG. 7 shows a case 7A corresponding to a neutral height configuration, where the ends 41 and 42 are arranged so that the distance R2 takes on a central value of the connecting rod center distance, in other words, corresponding to the case where the positions B11 and H11 are equidistant from the reference position P11. FIG. 7 shows a case 7B corresponding to a minimum height configuration, where the ends 41 and 42 are arranged so that the distance R2 assumes a minimum value of the connecting rod center distance, in other words, corresponding to the case where the stroke C11 is shifted to its lowest height relative to the reference position P11. FIG. 7 shows a case 7C corresponding to a maximum height configuration, where the ends 41 and 42 are arranged so that the distance R2 assumes a maximum value of the connecting rod center distance, in other words, corresponding to the case where the stroke C11 is shifted to its greatest height with respect to the reference position P11. FIG. 7 shows a case 7D corresponding to an intermediate height configuration, where the ends 41 and 42 are arranged so that the distance R2 assumes an intermediate value of the connecting rod center distance, in other words, corresponding to the case where the stroke C11 is shifted to a higher position relative to the reference position P11, without being at the maximum.

Preferably, the adjustment system comprises height adjustment stops, to limit the movement, that is, here the sliding, of the ends 41 and 42 along the axis R40, between the position shown at 7B where the distance R2 takes the minimum value of the connecting rod center distance and the position shown at 7C where the distance R2 takes the maximum value of the connecting rod center distance. The relative movement of the ends 41 and 42 is therefore only between these two positions, without going beyond. For example, to constitute the height adjustment stops, the transmission rod end sleeve 45 comprises a stop 46, formed by a parallelepipedal block screwed to the inside of the sleeve, and the transmission rod end 44 comprises a groove, forming two facing shoulders 47, framing the stop 46.

As shown in FIG. 7 for cases 7B and 7C, the stop 46 alternately abuts either of the shoulders 47, so that the sliding travel of the ends 41 and 42 is limited. As shown in FIG. 7 for cases 7A and 7D, the stop 46 moves freely between the shoulders 47 to obtain the intermediate values of the distance R2.

Preferably, the adjustment system comprises a set of amplitude adjustment graduations, indicating an amplitude adjustment value depending on the eccentric center distance R1. In this case, the set of graduations is, for example, marked on the base 31 while a graduation mark is marked on the connecting piece 32, or vice versa. Preferably, the adjustment system comprises a set of height adjustment graduations, indicating an amplitude adjustment value depending on the connecting rod center distance R2. In this case, the set of graduations is, for example, marked on the transmission rod end 44, while the edge of the transmission rod end sleeve 45 serves as a marker.

In the locked configuration of the adjustment system, used especially when weaving with the loom 1, the rotation of the eccentric system 30 about the axis X20 relative to the frame 12 by the actuator 20, causes the frame 11 to move, by means of the pulling mechanism. While the rotation of the eccentric system 30 is carried out without changing the direction, the levers 50 and 70 pivot in oscillation and the frame 11 is in reciprocating translation. With each complete revolution of the eccentric system 30 about the axis X20 relative to the frame 12, the levers 50 and 70 have pivoted in one direction and then in the other and returned to their initial position, and the heald frame 11 has traveled the stroke C11 in both directions and returned to its initial position. In detail, when the eccentric system 30 makes a first half rotation, the heald frame 11 is driven from the lower end position B11 to the upper end position H11. When the eccentric system 30 continues to rotate without changing direction, the heald frame 11 is driven in the opposite direction from the high end position H11 to the low end position B11.

Figure 5:
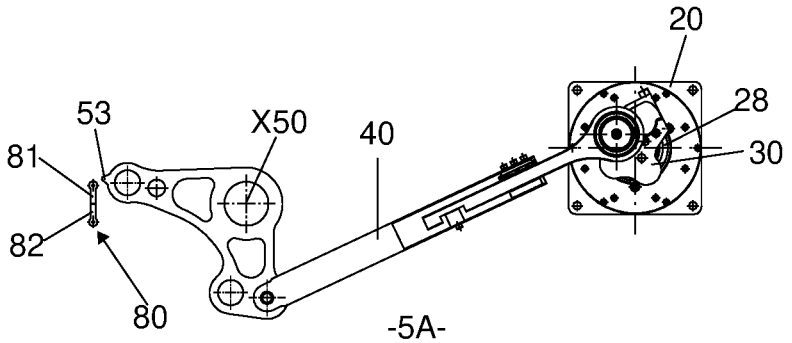
FIG. 5 shows several side views of the shedding machine of FIGS. 2 to 4, illustrating steps of implementing a locked configuration.
Figure 5:
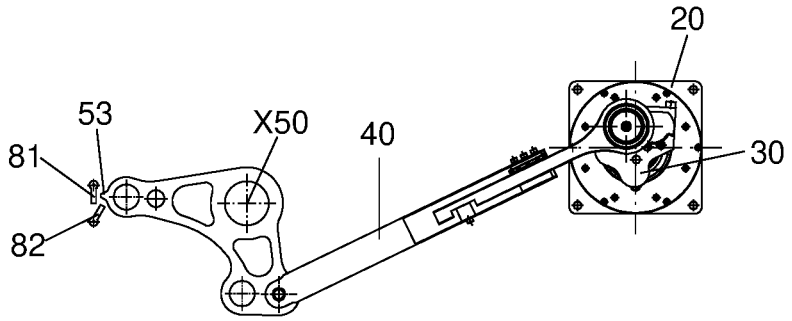
Figure 5:
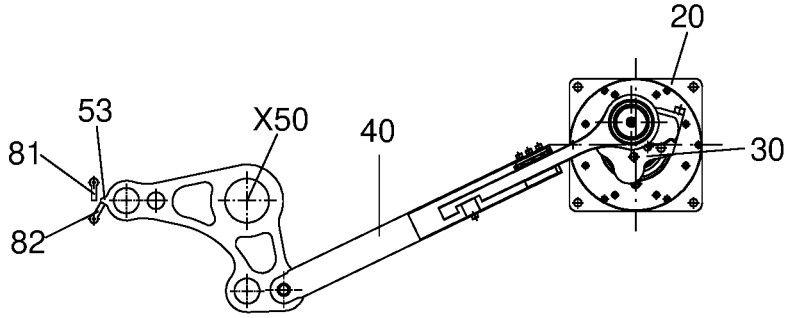
Figure 5:
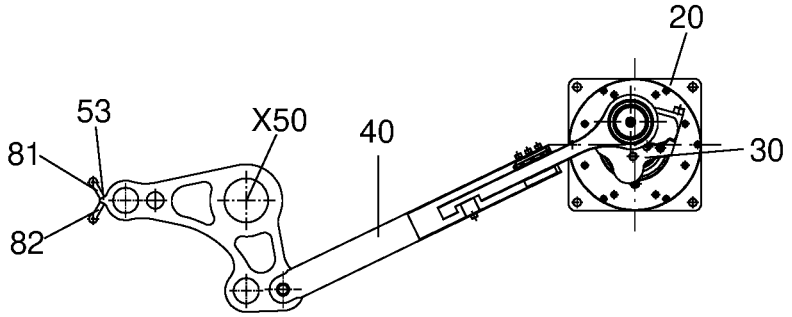

The locking system 80 allows for a locked configuration, shown in FIGS. 2, 6, and 7, as well as in case 5D of FIG. 5, and a release configuration shown in FIG. 1 and in the case 5A of FIG. 5.

In the locked configuration, the locking system 80 locks the orientation of all the levers 50 of the loom 1 to a reference orientation, preferably corresponding to the case where the heald frames 11 are all positioned at the reference position P11. Thus, the levers 50 are all locked in a known orientation, namely the reference orientation. Preferably, the reference orientation is chosen to correspond to an orientation that the lever 50 assumes when both the distance R1 is halfway between the minimum value of the eccentric center distance, shown in case 6B of FIG. 6, and the maximum value of the eccentric center distance, shown in case 6A of FIG. 6, and the distance R2 is halfway between the minimum value of the connecting rod center distance and the maximum value of the connecting rod center distance. The reference orientation is chosen to correspond to an orientation that the lever 50 assumes when the lever 50 is at the midpoint of its pivoting in oscillation, with the motor itself at an angular position corresponding to the midpoint between the two turn-back points of the transmission rod 40 in its oscillation cycle.

In the release configuration, the locking system 80 does not oppose the pivoting of the levers 50. Advantageously, it is provided that the locking system 80 will lock all of the levers 50. Alternatively, several locking systems 80 could be provided, each ensuring the locking of a group of levers 50 related to a set of neighboring frames, or to a single lever 50.

It is provided that the locking system 80 would be in a release configuration for weaving. It is provided that the locking system 80 will be in the locked configuration when the adjustment system is in the adjustment configuration. When the locking system locks the pivoting of the lever 50 to the reference orientation, the rotary electric actuator 20 varies the eccentric center distance R1, in the case where the adjustment system is in the amplitude adjustment configuration. Indeed, with the lever 50 being immobilized, the rotation of the base 31 by the actuator 20 causes a variation of the center distance R1 by rotation of the base 31 relative to the connecting piece 32, about the axis X32. The center distance R1 is varied over its entire adjustment travel by causing the base 31 to move through an angular sector, preferably less than half a revolution, using the actuator 20, as shown in FIG. 6. When the locking system locks the pivoting of the lever 50 to the reference orientation, the rotary electric actuator 20 varies the eccentric center distance R2, in the case where the adjustment system is in height adjustment configuration. Indeed, with the lever 50 being immobilized, the rotation of the base 31 by the actuator 20 causes a variation of the center distance R2 by relative sliding of the ends 41 and 42. The center distance R2 is varied over its entire adjustment stroke by causing the base 31 to move through an angular sector, preferably less than half a revolution, using the actuator 20, as shown in FIG. 7. Thus, the shed adjustment can be performed by means of the actuator 20, whether the actuator is controlled by an automatic adjustment program, or by an operator. Alternatively, the eccentric center distance R1 can be varied by manually driving the rotation of the base 31 by the operator. In this alternative, the use of the graduation set may be advantageous to assist the operator.

In the present example, the locking system 80 comprises an upper rocker stop 81 and a lower rocker stop 82. The stop 81 is pivotally actuated relative to the frame 12 about an axis X81 by an actuator 83. The pivoting is operated between a stop position, where the stop 81 limits the pivoting of the lever 50 to the reference orientation by mechanically cooperating with the lever 50, for a first direction of rotation of the lever 50, and a release position, where the stop 81 is released from the lever 50 so as not to oppose its pivoting. The stop 82 is pivoted relative to the frame 12, about an axis X82, by an actuator 84, independently of the orientation of the stop 81. The axes X81 and X82 are parallel to the axis X20. The pivoting is operated between a stop position, where the stop 82 limits the pivoting of the lever 50 to the reference orientation by mechanically cooperating with the lever 50, for a second direction of rotation of the lever 50, and a release position, where the stop 82 is released from the lever 50 so as not to oppose its pivoting. To mechanically cooperate with the stops 81 and 82, the arm 51 of the lever 50 includes a lug 53 that comes into abutment with one and the other of the stops 81 and 82, when the related stop is in the stop position. When both stops 81 and 82 are in the stop position, the locked configuration is achieved in that the lug 53 is captured between the two stops 81 and 82, with the lever 50 locked in the reference orientation.

Each actuator 20 is preferably a servomotor, or any other type of electric motor that allows a control of the orientation of the rotor about the axis X20. In particular, each actuator 20 comprises an encoder and/or a sensor system, the measurement of which makes it possible to determine the orientation of the output shaft 28, and therefore implicitly by conversion, the position of the base 31 of the eccentric system 30, about the axis X20, relative to the frame 12, in knowing the geometry of the system. Each actuator 20 advantageously comprises output plugs, connectable to a network 22 of the loom 1, such as a measurement bus, to transmit said measurement.

The shedding machine 2 advantageously comprises one or more actuator microcontrollers 23 for controlling the actuator 20 by controlling the power circuit 21 distributing electrical energy to this actuator 20, taking into account said measurement of the orientation of the output shaft 28, retrieved via the network 22.

Advantageously, the loom 1 comprises a master controller 24, which exchanges data with the actuator microcontroller(s) 23. The master controller 24 can run a weaving program to control the weave of the loom, controlling the actuators 20, and other programs, such as an adjustment program, a calibration program, etc. For the control, the microcontroller 23 and/or the master controller 24 take into account a library, which includes certain data, in particular remarkable pre-registered actuator positions, entered at the terminal, or even entered by calibration procedure. Advantageously, the controller has memories for the data libraries. A memory is able to store a current actuator position data or data related to predetermined positions to be reached. For example, a memory may store the position of the rotary actuator corresponding to the stop position against a stop 39 during amplitude adjustment. The controller can call up its memories and position data at any time to perform control steps. The controller is associated with a computer and a comparator in the servo control of the actuator which allow to quantify the movements necessary to reach predetermined positions. In particular, the controller, knowing the current position of the actuator, calculates the predetermined angle corresponding to the anticipated rotation according to the position of the stop to be reached. The memories are configured to enter, store or return this data to the controller.

Each actuator 83 and 84 is preferably a servomotor, or any other type of electric motor that allows a control of the orientation of the stops 81 and 82 about their respective axis X81 and X82. In particular, each actuator 83 and 84 comprises an encoder and/or a sensor system, the measurement of which makes it possible to determine the orientation of the related stop. Each actuator 83 and 84 advantageously comprises output plugs, connectable to a network 86 of the loom 1, such as a measurement bus, to transmit said measurement. The loom 1 advantageously comprises one or more actuator microcontrollers 87 for controlling the actuators 83 and 84 by controlling a power circuit 85 distributing electrical energy to the actuators 83 and 84, taking into account said measurement of the orientation of the output shaft 28, retrieved by means of the network 86. The master controller 24 exchanges data with the actuator microcontroller(s) 87.

The loom 1 preferably comprises a terminal 25 to allow an operator to control and/or parameterize the operation of the loom 1 via the master controller 24. For example, the terminal 25 proposes to the operator to start a specific step of a setting procedure, to validate that a manual step has been performed and/or to enter parameters. The terminal 25 serves to display information about the progress of the procedure and to indicate warning signals to the user.

Figure 17:
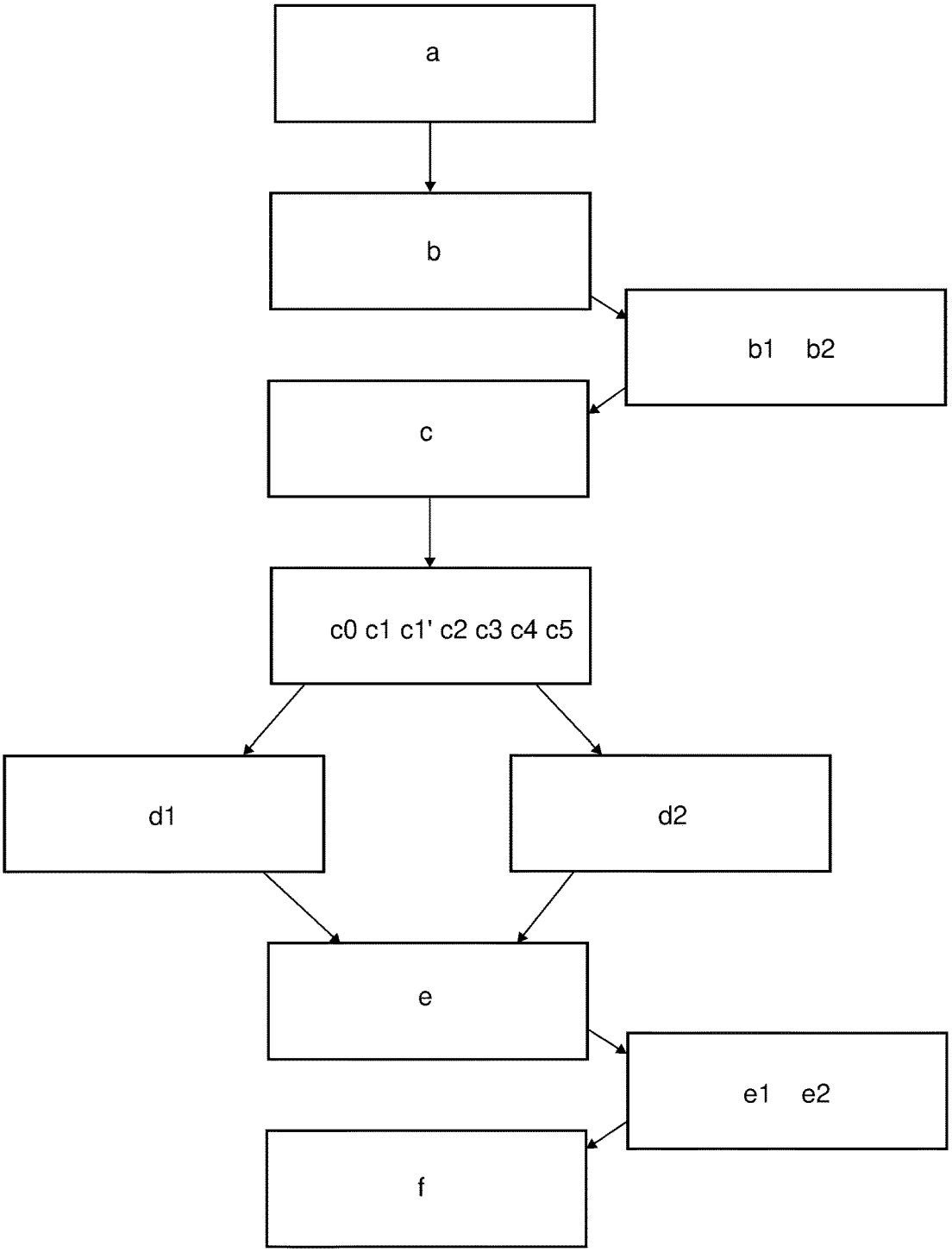
FIG. 17 is a block diagram of an adjusting method in accordance with the invention.

The loom 1, and more particularly each shedding machine 2, allows for the implementation of an adjusting method defined below and illustrated in FIG. 17.

When the loom 1 has been assembled for the first time, or during a maintenance or calibration operation, for all or some of the machines 2, remarkable angular positions for the actuator rotor 20 are recorded, corresponding to available shed configurations and positioning of the heald frame 11 in its stroke. In particular, remarkable angular positions are recorded corresponding to cases where the heald frame 11 is positioned at positions B11, H11 and P11, when the locking system is in the locked configuration. Other remarkable angular positions corresponding to amplitude and shed height adjustment configurations are also stored, as the machine or the operator can use these configurations to adjust the adjustment system. Similarly, remarkable angular positions for each adjustment configuration are stored in memories, corresponding to different cases where the ends 41 and 42 are in abutment, and the connecting piece 32 is in abutment relative to the base. Many configurations are possible, in that, depending on the height adjustment, the angular position of the actuator 20 to reach the amplitude adjustment stops changes, and vice versa. This data is stored in the data library, physically in the controller memories.

For example, one may choose to record, while the lever 50 is in the reference orientation, a minimum value, a median value, and a maximum value of the distance R2, the minimum and maximum angular positions of the actuator 20, corresponding to the abutment of the screw 38 alternately with the shoulders 39, and, for a minimum value, a median value, and a maximum value of the distance R1, the minimum and maximum angular positions of the actuator 20, corresponding to the abutment of the stop 46, alternately with the shoulders 47. For example, the minimum angular position of the actuator is a first target value, or the maximum angular position of the actuator is a second target value, or both the minimum and maximum angular positions are target values, if it is desired to detect adjustment faults.

Knowing these remarkable angular positions in advance allows later detection of possible faults during the adjusting method or during weaving, especially if the angular position at which the actuator 20 brings the pulling mechanism to a stop does not correspond to the remarkable angular position expected in the considered context.

In summary, the actual adjusting method first comprises a step a, comprising pivoting the lever 50 to the reference orientation, by rotating the eccentric system 30 by means of the rotary electric actuator 20, while the adjustment system is in the locked configuration and the locking system 80 is in the release configuration. The method then comprises a step b, comprising putting the locking system 80 in a locked configuration, thereby immobilizing the lever 50 in the reference position. The method then comprises a step c, comprising putting the adjustment system in an adjustment configuration. This may be the amplitude adjustment configuration, or the height adjustment configuration. When the height and amplitude are to be adjusted, this is done successively, in the desired order. In the case where the adjustment system is in the amplitude adjustment configuration, the method comprises a step d1 of adjusting the eccentric center distance R1 by rotating the eccentric system 30 by means of the rotary electric actuator 20, the adjusting method using data from the memory, corresponding to a target value or an incremental value relative to a desired frame height. In the case where the adjustment system is in a height adjustment configuration, instead of step d1, a step d2 is provided for adjusting the connecting rod center distance R2 by rotating the eccentric system 30 with the rotary electric actuator 20, the adjusting method using data from the memory, corresponding to a target value or an incremental value relative to a desired frame height. Once the adjustment completed, the method comprises a step e, comprising putting the adjustment system into a locked configuration. Finally, the method comprises a step f, comprising putting the locking system 80 into a release configuration. Weaving may be performed with the new setting.

More specifically, for example, to begin the adjusting method, it may be provided that an operator indicates to the loom 1 to initiate the adjusting method via the terminal 25.

To perform steps a and b, the levers 50 first pivot to an orientation close to the reference orientation under the action of the actuators 20 controlled by the controllers 23 and 24, as shown in case 5A of FIG. 5, while the system 80 is in the release configuration. Then, all the lugs 53 are positioned above the stop 82. Advantageously, it is provided that the actuators 20 will position the eccentric system 30 so that the end 41 is positioned in an upper quadrant of rotation of the actuator 20, so that the adjustment system is accessible to the operator at a later stage. Then, under the action of the actuator 84 controlled by the controllers 24 and 87, the stop 82 is tilted to the stop position, as shown in case 5B. Then, under the action of the actuators 20 controlled by the controllers 23 and 24, the levers 50 are pivoted until they come into abutment against the stop 82, as shown in case 5C. At least for this step, it is provided that the driving torque of the actuator 20 is limited below a predetermined set torque value. With the torque thus limited in this manner, contact with the stop 82 by the lever 50 is accomplished without risk of breakage, and the actuator 20 can detect when the lever 50 is at the stop. If the actuator 20 is a servomotor, its power supply is turned off so that it no longer has a motor brake, as the weight of the heald frame 11 and the pulling mechanism keeps the lever 50 in contact with the stop 82. The angular position of the actuator 20 at this time is stored as the angular position corresponding to the reference orientation of the lever 50. Finally, under the action of the actuator 83 controlled by the controllers 24 and 87, the stop 81 is tilted to the stop position, as shown in case 5D. In this locked configuration, the assembly formed by the frame, the connecting rods, the levers and the eccentric systems are fixed relative to the frame 12 of the loom 1.

In this example, steps a and b are therefore performed in a fully automatic manner, under the control of the operator. As a variant, manual steps are provided, especially in the case of a non-motorized locking system, where the operator manually tilts the stops 81 and/or 82. As a variant, a single actuator tilts the two stops 81 and 82 in a time-staggered manner.

At this stage, before starting step c, the method advantageously comprises a so-called locking check step, which aims to verify whether the locking system 80 effectively immobilizes the lever 50. This step comprises a restoration of the power supply to the actuator 20, with limiting below the set torque value. The locking control step comprises a step b1 to verify that the rotary electric actuator 20 does not rotate, including a transmission of a rotational drive command by the actuator 20, in other words, a rotational command of the actuator 20, and then a measurement of the angle of rotation described by the eccentric system 30 while the actuator 20 has executed this drive command. Finally, step b1) includes a comparison of the measured angle of rotation with a target value, to establish whether the locking system 80 is properly in the locked configuration, or in a locking fault situation. Preferably, a rotation of the actuator 20 in both directions is provided, which allows to verify that the two stops 81 and 82 are effectively locking the lever 50. In other words, it is verified that the rotary actuator does not rotate under the application of a predetermined torque value, the delivered motor torque being monitored during this measurement. In practice, in order to consider that the locking system 80 is duly in the locked configuration, it is verified that the angle of rotation is zero or almost zero while the delivered motor torque is higher than the passive torque of the system, of the order of two times higher than the torque exerted on the motor by the weight of the frame and the transmission, insofar as, in the locked configuration and in the locked configuration, the pulling mechanism is normally entirely immobilized. In this case, the adjusting method is continued. On the contrary, it is considered that the locking system is not in locked configuration when the actuator 20 has covered an angle that is not zero, or greater than a predetermined threshold. At this point, it is known that this is normally not a failure of locking the adjustment system, since weaving may have been performed before, a previous adjusting method may have been performed successfully, or the operator has not yet intervened to put the adjusting system in the adjustment configuration. In any case, if it is considered that the locking system 80 is not in the locked configuration, a step b2 is provided including issuing an alarm to the operator, for example via the terminal 25, signaling the locking fault. Then, the method is interrupted so that corrective measures can be taken. For example, steps a and b of pivoting the levers 50 and putting them in the locked configuration can be repeated. Alternatively, it can be provided for step b2 that the controller triggers a corrective action if the system has electronic locking means capable of following a new locking step.

The step c of putting into the adjustment configuration is carried out manually by the operator. For safety reasons, it is provided that the power supply to the actuator 20 is switched off while the operator changes the adjustment system from the locked configuration to the adjustment configuration. In practice, the operator unlocks the locking means manually. In the present example, the operator loosens either the screw 93 without loosening the screw 98, to move into the amplitude adjustment configuration, or the screw 98 without loosening the screw 93, to move into the height adjustment configuration. Once in the adjustment configuration, the braking means 91 and/or 92 prevent the pulling mechanism from becoming out of adjustment under its own weight, by preventing the variation of the distance R1 or R2 that has been made adjustable.

Preferably, the method comprises a precheck step, performed after step c and before step d1 or d2, to verify that the desired adjustment configuration has been duly achieved, in other words, that the correct screws have been loosened, and that they have indeed been loosened. This pre-check includes a step c0 of transmitting a command for the actuator 20 to rotate the system 30, in other words, to control the rotation of the actuator 20. In practice, the actuator 20 executes the command until one of the stops is reached, to serve as a reference. At this point, a step c1 is provided to measure the angle of rotation that has been described by the eccentric system 30 that has executed this command. Depending on the situation, this stop corresponds to one of the minimum or maximum values of the center distance, connecting rod or eccentric. A step c1' is then provided for comparing the measured angle of rotation with a predetermined angle corresponding to the predicted rotation based on the position of the stop, in order to establish whether the shedding machine 2 is in a nominal situation or in a fault situation, such as a loosening fault or an adjustment fault.

This preliminary check then includes a step c2 of transmitting a command to rotate the system 30, in the reverse direction, by the actuator 20. In other words, the actuator 20 is controlled in rotation. In practice, the actuator 20 executes the command until it reaches the other stop. This other stop corresponds to the other minimum or maximum value of the center distance, connecting rod or eccentric. These instructions are transmitted while the actuator 20 is limited below the set torque value, to avoid any risk of breakage if the stop is not encountered at the expected angular position, and also to be able to detect the resistance of the stop. The precheck includes a step c3 of measuring the angle of rotation described by the rotor, in other words, by the eccentric system 30, following the execution of the rotational command, where the actuator 20 is supposed to have driven the pulling mechanism from the first stop to the second stop. The precheck includes a step c4 of comparing the measured angle with a target value that has been prerecorded in the library, to establish whether the machine 2 is in a nominal situation, or in a fault situation, such as a loosening fault or an adjustment fault. In other words, the measured angle is compared with a predetermined angle corresponding to the rotation that can be expected from the position of the adjustment stop.

For example, if the measured angle is zero or very small, it is identified that the adjustment system has remained in a locked configuration. This is a loosening fault. For example, if the measured angle corresponds to that of an amplitude adjustment range, when a height adjustment configuration was desired, it is identified that the adjustment system was mistakenly put in the amplitude adjustment configuration. This is another loosening fault. For example, if the measured angle corresponds to that of a height adjustment range, while an amplitude adjustment configuration was desired, it is identified that the adjustment system has been set to a height adjustment configuration by mistake. This is another loosening fault. For example, if the measured angle corresponds to the sum of the height adjustment and amplitude adjustment ranges, it is identified that the adjustment system has been put into a configuration where the two distances R1 and R2 are variable, by loosening all the locking means of the adjustment system. This is another loosening fault. For example, if the measured angle of rotation does not correspond at all to an angle corresponding to the above situations, this may be an adjustment fault, indicating that a previously performed adjusting method was carried out incorrectly or that the adjustment system went out of adjustment during weaving.

When a fault is detected, a step c5 of issuing an alarm is provided, preferably for the attention of the operator, for example via the terminal 25, to indicate to the operator that a fault has occurred, and the type of fault identified. The adjusting method is interrupted so that corrective action can be taken, especially performing the adjustment configuration step correctly. Otherwise, the method goes directly to the adjustment step d1 or d2.

Alternatively, the prechecking step may be performed by checking for the attainment of a single stop from an expected angular displacement range to the first stop.

Providing that the lever 50 is locked at the reference orientation by the locking system 80 allows the amplitude adjustment step d1 or the height adjustment step d2 to be performed by actuating the actuator 20. In order to perform the adjustment, it may be provided that the actuator 20 is actuated upon command from the operator, for example via the terminal 25. For example, it may be provided that the operator commands the actuator 20, by means of the terminal 25, increments of rotation of the actuator 20 until the desired setting for the amplitude or height of the stroke C11 is reached. It may also be provided that the operator instructs the actuator 20 to position the output shaft 28 directly at an angular target value, in order to achieve the desired adjustment. The rotary electric actuator 20 is rotationally controlled according to a target value or incremental value command relative to a desired frame stroke or frame height. In other words, the rotational control of the electric rotary actuator comprises a target value or incremental value set point transmission to the electric rotary actuator 20, relative to an increase or decrease of an adjustment, from the eccentric center distance setting R1 or the connecting rod center distance setting R2.

The rotary electric actuator 20 is thus driven to the predetermined value. Provision can also be made for the operator to indicate the desired adjustment directly, and the actuator 20 then takes the angular position necessary to achieve that adjustment, based on the information in the library. Provision can also made for the operator to verify the adjustment using the set of graduations carried by the pulling mechanism. It can also be provided that the actuator 20 is operated automatically by the controller 24 to make the adjustment without the intervention of the operator, possibly under the supervision of the operator, the controller 24 executing a prerecorded adjustment program. Advantageously, to check whether the desired amplitude or height value is achieved, it is provided that the terminal 25 indicates, based on the angular position information provided by the actuator 20, the current adjustment. It can be provided that all actuators 20 perform the adjustment of the machines 2 at the same time, in particular if the adjustment is performed automatically based on the prerecorded adjustment program.

During the adjustment step, whether it is step d1 or step d2, it can be provided that the motor torque of the actuator 20 is limited below the adjustment torque value. For verification of the adjustment by the operator, it may be provided that the power to the actuator 20 is turned off for safety reasons. Once the adjustment has been made, the angular position of the actuator 20 is stored in the library as the current adjustment for the actual machine 2. This adjustment value can be called up later, for example during a new adjustment method.

Once the height adjustment step d2 is performed, a new amplitude adjustment configuration step c may optionally be provided, followed by a new amplitude adjustment configuration step d1. If the amplitude adjustment step d1 was performed first, a new height adjustment configuration step c may be provided, followed by a new height adjustment step d2. As previously seen, the new adjustment configuration step c may be followed by a pre-adjustment control step.

Since step c requires manual intervention, as previously seen, provision can be made to turn off the power supply to the actuator 20.

Once the adjustment step d1 and/or d2 is completed, the step e of putting the adjustment system in locked configuration is implemented. This step is performed manually by the operator, who locks the locking means, here by tightening the screws 93 or 98. For safety reasons, it is advantageously provided that the power supply to the actuator 20 is turned off during this step. During this step e, the locking system 80 is still in a locked configuration to keep the levers 50 immobile. Once this step e is completed, the distances R1 and R2 are fixed, since the ends 41 and 42 are fixedly secured to one another and the connecting piece 32 is fixedly secured to the base 31.

Preferably, once the step e of putting the machine into the locked configuration, a locking control step is implemented, in order to ensure that the machines 2 are duly in the locked configuration after the manual intervention of the operator. For this locking control step, the locking system 80 is held in the locked configuration. For this locking control step, the power supply to the actuator 20 is restored. Preferably, the torque of the actuator 20 is limited below the adjustment torque value. The locking control step comprises transmitting a rotational drive command of the actuator 20, measuring the angle of rotation described by the eccentric system 30 while the actuator 20 executes this drive command, and comparing the measured angle of rotation with a target value to establish, whether the control system is properly in the locked configuration, or in a locking fault condition. Preferably, rotation of the actuator 20 in both directions is provided. In other words, a step e1 is provided to verify that the rotary actuator does not rotate under the application of a predetermined torque value, the delivered motor torque being monitored during this measurement. In practice, in order to consider that the adjustment system is duly in the locked configuration, it is verified that the angle of rotation is zero or almost zero while the delivered motor torque is greater than the passive torque of the system, of the order of twice the torque exerted on the motor by the weight of the frame and the transmission, insofar as, in the locked configuration and in the locked configuration, the pulling mechanism is normally entirely immobilized. In this case, the adjusting method is continued. On the contrary, it is considered that the locking system is not in locked configuration when the actuator 20 has traversed an angle that is not zero, or greater than a predetermined threshold. At this point, it is known that this is not a locking fault, since the previous steps, in particular the adjustment step, have been executed. If it is considered that the adjustment system is not in the locked configuration, a step e2 is provided which includes emitting an alarm, preferably for the attention of the operator, for example via the terminal 25, signaling the locking fault. Then, the method is interrupted so that corrective measures can be taken. For example, step e of putting the system into a locked configuration can be restarted, or a corrective action can be triggered via the controller if the system has electronic locking means to implement.

To perform step f of putting the locking system into a release configuration, one proceeds essentially in reverse order relative to steps a and b, in other words, the steps shown in FIG. 5, from case 5D to case 5A are implemented. More precisely, starting from case 5D in FIG. 5, the stop 81 is tilted to the released position using the actuator 83 to reach case 5C, while the power supply to the actuator 20 is advantageously turned off. Next, power is supplied to actuator 20, so that actuator 20 operates the pulling mechanism to orient lever 50 to move the lug 53 away from stop 82, resulting in case 5B in FIG. 5. Finally, stop 82 is moved to the release position, so that the locking system 80 is fully in the release configuration. Alternatively, step f can be modified depending on the design of the locking system 80, potentially including a manual step, as explained above for the step of moving to the locked configuration.

It is optionally provided that the operator confirms, via the terminal 25, that the adjusting method has been successfully completed. Weaving can then be started with the new shed setting.

In the locked configuration of the adjustment system and in the locked configuration of the locking system, provision may be made for transmitting a movement command to the actuator 20, for example by alternating commands in one direction of rotation and then in the opposite direction, back and forth, and measuring the amplitude available for rotation of the rotor, which is analyzed by the controller 24. This amplitude reflects the sum of the clearances between the lever 50 and the eccentric system 30, particularly in the articulations at the level of the bearings of the transmission rod 40 and the lever 50. This amplitude can be interpreted by the controller 24 as mechanical clearances knowing the geometry of the relevant shedding machine. This operation can be performed for each pulling mechanism of the loom. This operation can be performed during the locking control step described above. In addition, it can be provided to follow the drift of these mechanical clearances during the weaving cycles, and to compare the whole of these measurements between them or/and of a shedding machine relative to the other, in order to estimate the possible degradation of mechanical components, and to anticipate their replacement. Knowing the height of the shed and the amplitude of the shed for each shedding machine also allows to refine the predictive models of damage calculation and to indicate to the operator the performance indices or the utilization rates of the machine.

Optionally, when a height adjustment configuration is desired, the eccentric system 30 is oriented under the action of the actuator 20 so that the screw 93 is in an area not accessible by the operator, thereby reducing the risk of the operator accidentally putting the adjustment system in the amplitude adjustment configuration by loosening the screw 93.

Optionally, a cover is provided that covers the screw 98 when it is desired to perform an amplitude adjustment configuration, to reduce the risk of the operator accidentally putting the adjustment system in a height adjustment configuration by loosening the screw 98. Similarly, a cover can be provided that covers the screw 93 when a height adjustment configuration is desired.

As a variant, it is provided that the actuator 20 has braking means embedded in the casing, or that the actuator 20 comprises a braked gearbox to drive the output shaft 28. These solutions address the problem of immobilizing the actuator 20 during manual interventions on the machine 2.

As a variant, as a locking system, an actuator is provided to lock the lever 50 in place of the tilting stops 81 and 82. The lug 53 of the lever 50 is placed directly in the horizontal position and locked by an actuator adapted to act on the walls of the lug 53.

Optionally, the adjustment of the heald frames 11 can be performed iteratively to adjust the amplitude or/and the height of stroke C11 progressively, or by considering the movement of an adjacent heald frame 11.

As a variant, the lever 50 may present a different geometry, including having a horizontal arm for connection to the connecting rod 17, a lower vertical arm for coupling to the connecting rod 60, and an upper vertical arm opposite its axis X50 for coupling to the transmission rod 40. The upper H11 and lower C11 positions of the heald frame 11 are thus inverted relative to the same motor stroke.

In a variant not shown, the actuators 20 are installed upside down on the frame 12.

As a variant the connecting rods 17 and 18 are connected to the heald frame 11 by means of the crossbeam 14.

As a variant the loom is a double weaving loom.

As a variant, the connecting piece is movable relative to the base in translation, without rotation, along a radial translation axis that is fixed relative to the connecting piece, to vary the distance R1.

As a variant the height adjustment brake is constituted by an elastic yoke replacing the bracket 96 and the springs 92 and applying an elastic force on the transmission rod end 44 to brake the relative sliding of the transmission rod ends 44 and 45.

As a variant, automatic means are provided for moving the machine 2 between the locked configuration and the adjustment configuration, including, for example, a motor or an electromagnet.

As a variant, during weaving, the actuators 20 can be selectively operated in a clockwise or counterclockwise direction of rotation, according to the weave to be performed. In particular, when two actuators 20 are made to perform the same weave in weaving configuration during several insertion cycles, one first actuator 20 can be operated in a clockwise direction and the other actuator 20 in a counterclockwise direction so that their operation is kinematically balanced and the movement of the counterbalance weights related in particular to the eccentric systems 30 is symmetrical for the loom, which limits the loads in the articulations and preserves the loom.

The method described above also applies, once the necessary changes have been made to the other embodiments described below.

Figure 8:
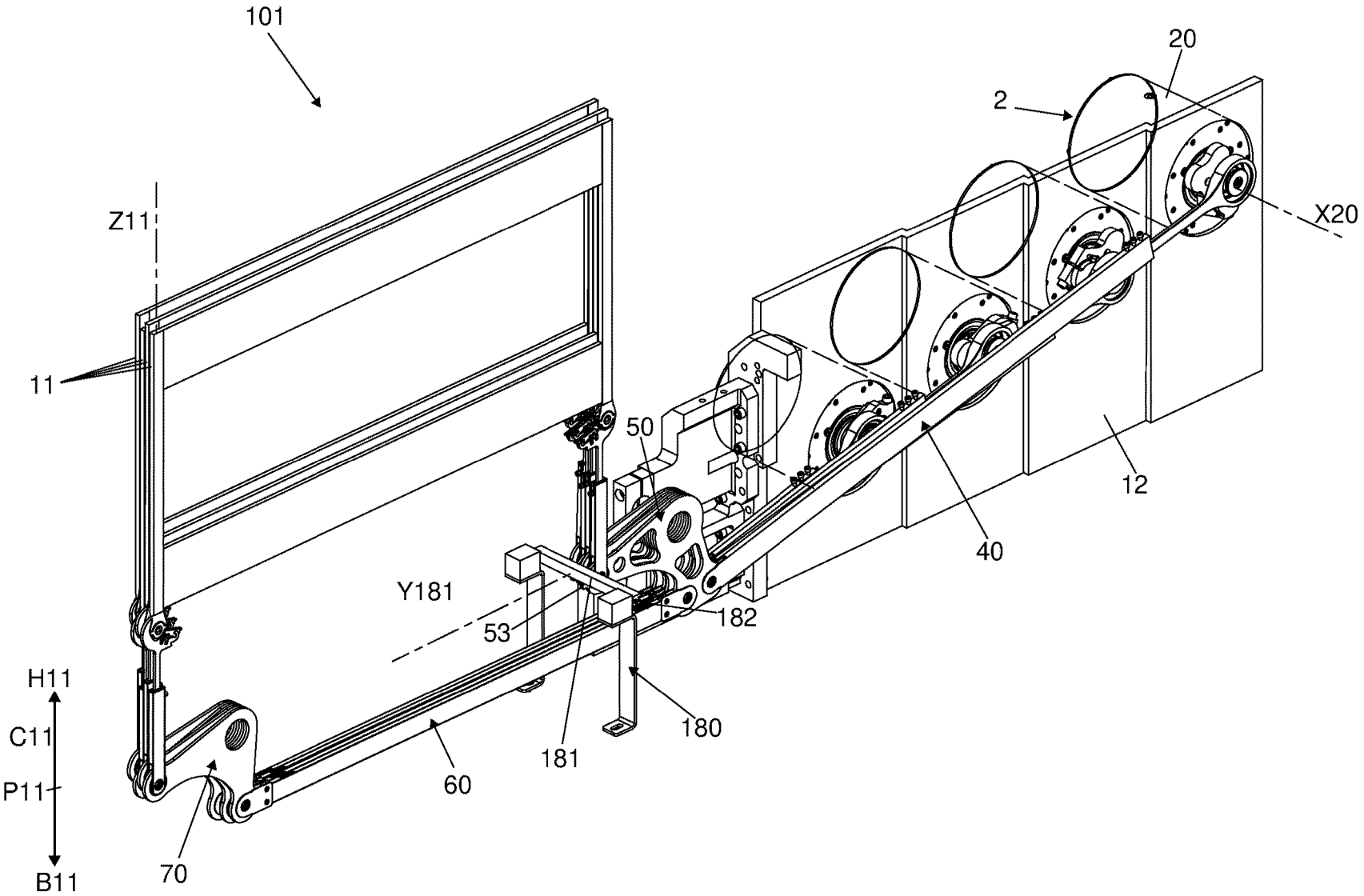
FIG. 8 is a partial perspective view of a loom equipped with four shedding machines, according to a second embodiment of the invention.

FIG. 8 shows a second embodiment, with a loom 101 identical to the loom 1 of FIGS. 1 to 7, except for the following differences. In the figures, identical or like-functioning elements provided for the embodiment of FIGS. 1 to 7 and subsequent embodiments are designated with the same reference signs.

For the loom 101 in FIG. 8, the locking system 80 has been replaced with a locking system 180, which includes a stop 181 in place of the stops 81 and 82. In order to evolve between the release configuration and the locked configuration, it is provided that the stop 181 translates along an axis Y181, perpendicular to the axes Z11 and X20, for example under the action of a cylinder not shown. The stop 181 is at the level of the lug 53 of the levers 50, when the levers 50 are in the reference orientation. The stop 181 comprises a groove 182, parallel to the axis X20 and open towards the levers 50, within which the lugs 53 are received when the locking system 180 is in the locked configuration. In the release configuration, the stop 181 is released from the levers 50 by being moved back relative to the levers 50, the groove 182 then no longer opposing the pivoting of the levers 50.

Figure 9:
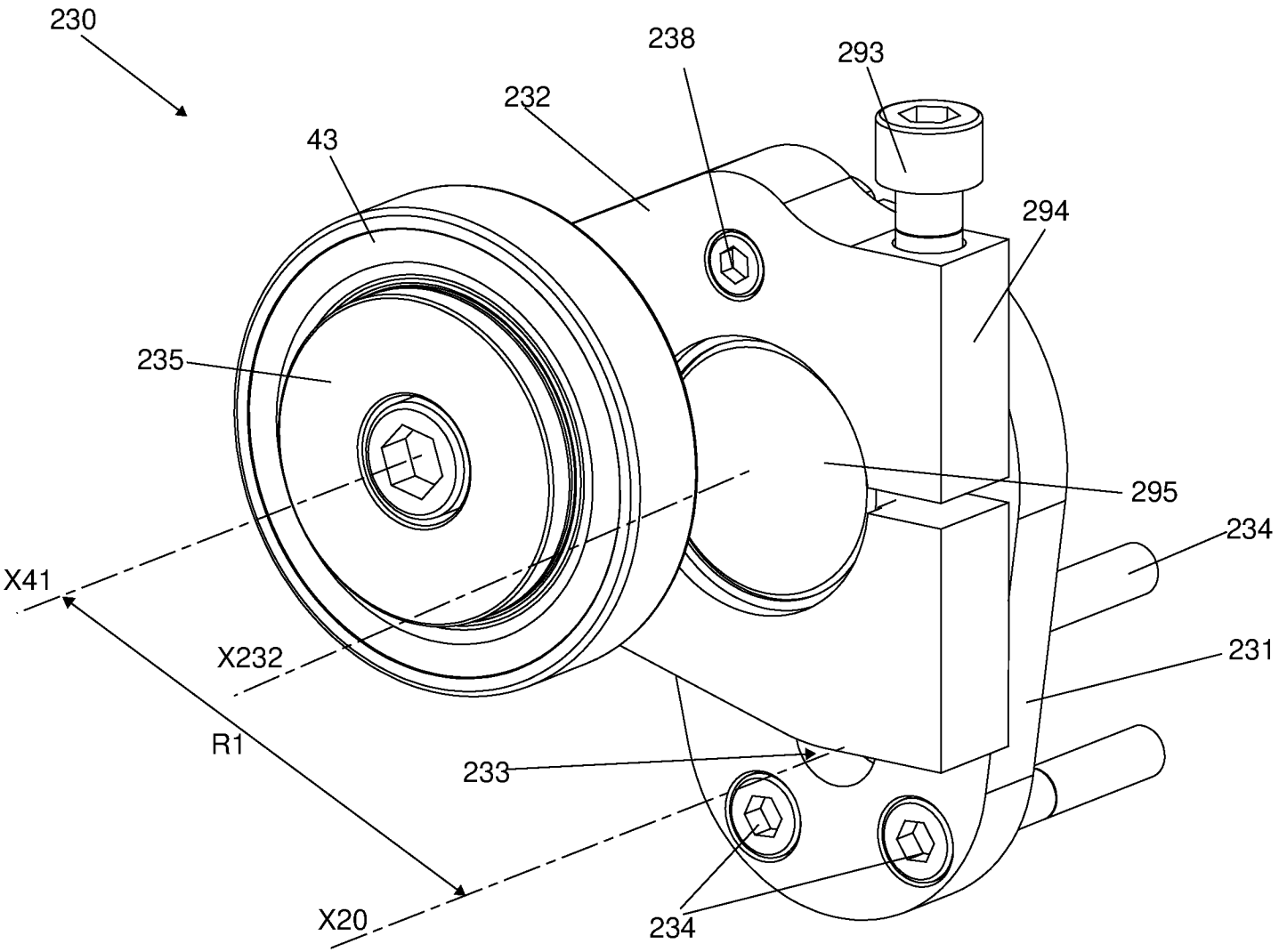
FIG. 9 is a perspective view of an eccentric system belonging to a shedding machine, according to a third embodiment of the invention.
Figure 10:
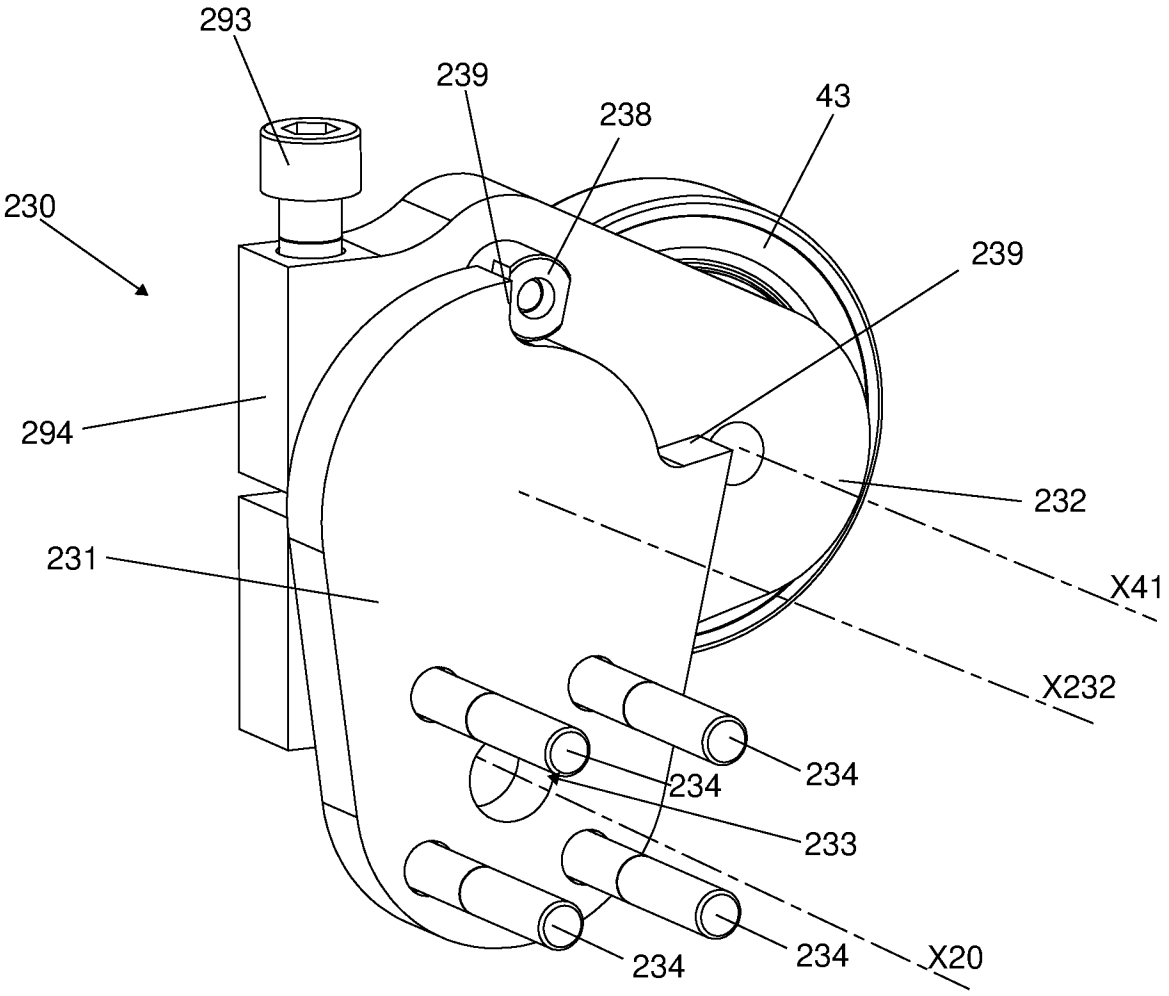
FIG. 10 is a perspective view of the eccentric system of FIG. 9, from another angle.

FIGS. 9 and 10 show an eccentric system 230 for a third embodiment, with a loom identical to the loom 1 of FIGS. 1 to 7, except precisely for this eccentric system 230, replacing the eccentric system 30. The eccentric system 230 is different in structure relative to the eccentric system 30, but nevertheless performs the same functions.

The eccentric system 230 comprises a base 231 and a connecting piece 232.

Along the axis X20, the base 231 is arranged between the actuator 20 and the connecting piece 232. The base 231 is fixed to the output shaft 28 of the actuator 20, so as to be directly driven in rotation about the axis X20 by the actuator 20, relative to the frame 12. The axis X20 is fixed relative to the frame 12 and relative to the base 231. The orientation of the output shaft 28 about the axis X20 corresponds to that of the base 231. By the intermediary of the base 231, the entire eccentric system 230 is rotated by the actuator 20 about the axis X20. The lever 50 is driven according to the oscillating pivoting motion by the continuous rotation of the eccentric system 230 by means of the transmission rod 40. The articulation end 41 of the transmission rod 40 is coupled to the connecting piece 232, so that the transmission rod 40 and the connecting piece 32 are pivotable relative to each other about the eccentric axis X41, which is fixed relative to the transmission rod 40 and relative to the connecting piece 232. The circular flange of the articulation end 41 receives within it a crankpin 235 belonging to the connecting piece 32, the crankpin 235 being pivotally supported within the flange, by means of the bearing 43. The axes X41 and X20 are spaced apart from each other by the eccentric center distance R1. When the eccentric system 230 rotates about the X20 axis, the X41 axis rotates about the X20 axis.

In the present example, in order for the eccentric center distance R1 to be adjustable when the adjustment system is in the amplitude adjustment configuration, the connecting piece 232 and the base 231 are pivotable relative to each other about an axis X232, referred to as the "crank axis." Axis X232 is fixed relative to base 231 and relative to connecting piece 232 and is parallel to axis X20. The axes X41 and X232 are not coaxial. When the connecting piece 232 is rotated relative to the base 231 about the axis X232, the axis X41 is moved relative to the axis X20 according to a circular path centered on the axis X232, thereby varying the distance R1. In this sense, the connecting piece 232 constitutes a crank relative to the base 231.

The base 231 is constituted by a piece that is generally flat in a plane perpendicular to the axis X20. The base 231 includes a main opening 233, receiving the output shaft 28 of the actuator 20 so that the base 231 is fixedly secured to this shaft. Several fasteners are also provided, in this case four screws 234, distributed about the axis X20, to ensure that the base 231 is rotationally fixedly secured to the output shaft 28 and/or with the rotor of the actuator 20.

In this embodiment, the connecting piece 232 includes a pinch ring 294, with two jaws radially surrounding the crank axis X232. The base 231 forms a crankpin 295, which is received within the pinch ring 294. The crankpin 295 presents in the form of a cylindrical member with a circular base, centered on the axis X232, and received within the jaws of the pinch ring 294, which has a complementary shape. The crankpin 295 projects from the flat part of the base 231, in the same direction as the crankpin 235 and is offset relative to the latter. A tightening of the pinch ring 294 about the crankpin 295 is ensured by a clamping screw 293, the head of which presses against one of the jaws of the ring 294, the body of which passes through this jaw and is screwed into the other jaw. Advantageously, the screw 293 is directed along an orthoradial direction relative to the axis X232. A screwing of the screw 293 tends to bring the jaws closer to each other, causing centripetal clamping forces to be applied to the ring 294 on the crankpin 295, resulting in a tightening torque. The base 231 carries the connecting piece 232 by means of its pinch ring 294, in that the crankpin 295 is received in the pinch ring 294.

The ring 294, the crankpin 295 and the screw 293 belong to the locking means of the adjustment system. Indeed, the piece 232 and the base 231 can be locked together by putting the screw 293 in a position of tightening the ring 294 around the crankpin 295. In the tightened position, the screw 293 clamps the ring 294 around the crankpin 295 so as to apply a sufficiently high torque so that, during weaving, the piece 232 remains immobile relative to the base 231. In the locked configuration, the screw 293 is therefore provided to be put in the tightened position. In the amplitude adjustment configuration, the screw 293 is put in a position of loosening the ring 294 about the crankpin 295, so that the ring 294 and the crankpin 295 form a pivotal connection, allowing and guiding the pivoting of the piece 232 relative to the base 231 about the axis X232.

Preferably, the adjustment system comprises an amplitude adjustment brake, not shown, similar to that provided for the loom 1 of FIGS. 1 to 7 and shown in FIG. 4.

Preferably, the adjustment system for the embodiment of FIGS. 9 and 10 comprises amplitude adjustment stops, for limiting the movement of the connecting piece 232 relative to the base 231, about the axis X232, between a position where the distance R1 takes the minimum eccentric center distance value and a position where the distance R1 takes the maximum eccentric center distance value. For example, to form the amplitude adjustment stops, the connecting piece 232 carries a stop screw 238, parallel to the axis X20, such that a head of the screw 238 projects from the surface of the connecting piece 232 on the side of the base 231. As best seen in FIG. 10, to form the amplitude adjustment stops, the base 231 includes two shoulders 239, which surround the stop screw 238. The screw 238 alternately abuts against one or the other of the shoulders 239, so that the pivotal travel of the piece 232 is limited. The screw 238 moves freely between the shoulders 239 to obtain the intermediate values of the distance R1.

As a variant, some machines 2 are equipped with the eccentric system 30 while other machines 2 of the same loom are equipped with the eccentric system 230, for example to optimize space and accessibility to the locking means.

FIGS. 11 to 14 show an actuator 320 an eccentric system 330 for a fourth embodiment, with a loom identical to the loom 1 of FIGS. 1 to 7, except specifically for the actuator 320 and the eccentric system 330, replacing the actuator 20 and the eccentric system 30. The actuator 320 and the eccentric system 330, however, perform the same functions.

Figure 13:
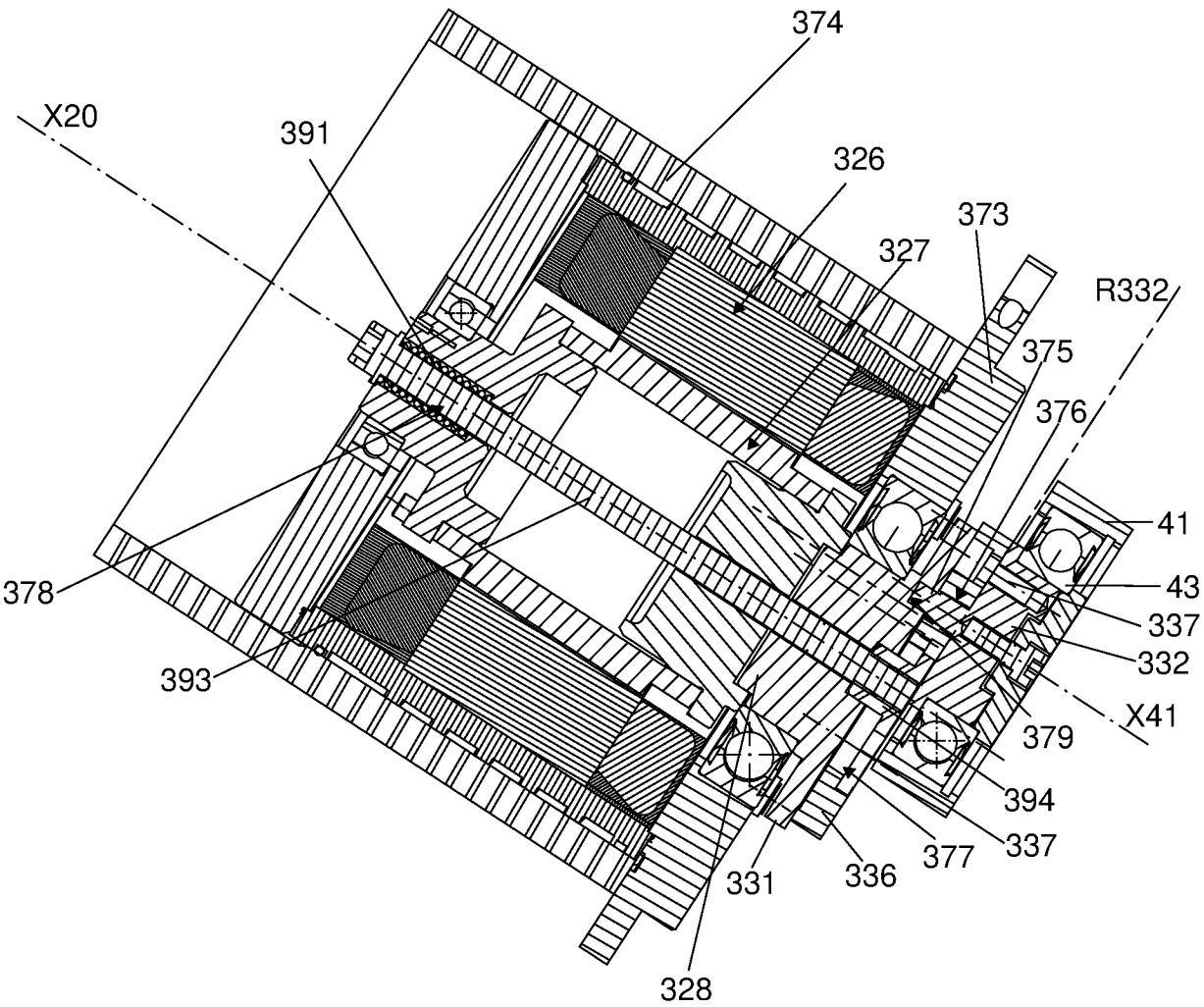
FIG. 13 is a cross-section of the shedding machine of FIGS. 11 and 12.

As shown in FIG. 13, the actuator 320 is an electric motor, which comprises a stator 326. The stator 326 includes a housing 374, which comprises a circular-based cylindrical wall centered on the axis X20 and a mounting plate 373, perpendicular to the axis X20, closing a front end of the cylindrical wall and serving to fixedly attach the stator 326 to the frame. A rotor 327 is supported by the stator 326 so as to be rotatable about the axis X20 relative to the stator 326. The rotor 327 is coaxial with the axis X20 and is contained within the stator 326. A front end of the rotor 327 here forms an output shaft 328 of the actuator 320, which extends through the mounting plate and opens to the outside. When the actuator 320 is appropriately electrically powered by the power circuit 21, the output shaft 328 is driven in rotation about the axis X20 by the rotor 327.

Alternatively, as explained above, the rotor and output shaft may be provided as separate, non-coaxial elements, with the rotor driving the output shaft by means of a gearbox, with the main axis X20 about which the output shaft rotates being parallel to the axis of rotation of the rotor.

Preferably, each actuator 320 comprises a resolver, not shown, consisting of a resolver rotor and a resolver stator, according to electrotechnical techniques known to the skilled person. The resolver rotor is preferably fixedly secured to with a hollow support attached to a rear end of the output shaft 328, such that the clamping screw 393 passes through the hollow support and the resolver rotor, from one side to the other. The resolver stator is fixedly secured to with the stator frame 374 of the stator 326. The measurement of the resolver from the rotation of its rotor in its stator allows the position of the base 31 relative to the frame 20 to be determined. Advantageously, the actuator 320 has a means of measurement by preserving the functions of the clamping screw 393.

Preferably, as with the actuator 20, it is provided that, during weaving, the actuator 320 performs a continuous rotation, in other words, a rotation without change of direction. Preferably, the actuator 320 is a servomotor, or any other type of electric motor that allows a control of the orientation of the rotor 327 about the axis X20. In particular, each actuator 320 comprises an encoder and/or a sensor system, not shown, the measurement of which allows the orientation of the output shaft 328 to be determined, according to the same principle as for the actuator 20. Each actuator 320 advantageously comprises output plugs, connectable to a network 22 of the loom 1, such as a measurement bus, to transmit said measurement. The same controllers as described above are employed to drive the actuator 320 as are employed to drive the actuator 20.

Figure 14:
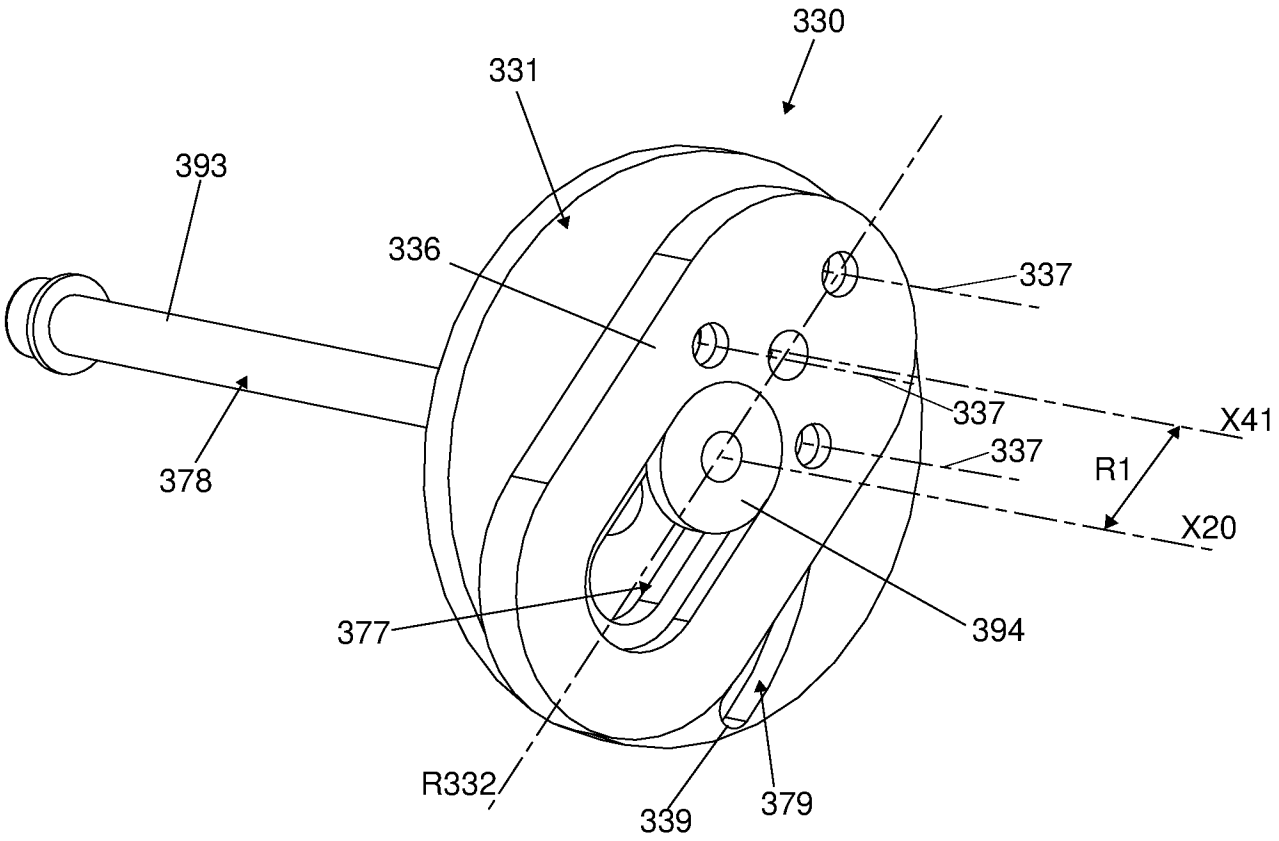
FIG. 14 is a perspective view of a portion of the shedding machine of FIGS. 11 to 13.

The eccentric system 330, best seen in FIG. 14, comprises a base 331 and a connecting piece 332.

As visible in FIG. 13, in the present embodiment, the base 331 and the output shaft 328 are formed by a single, integral part for reasons of compactness. However, it could be envisaged that these two elements are formed by separate parts, attached to each other.

The base 331 here forms a discoidal plate perpendicular to the axis X20, formed at one end of the output shaft 328. Along the axis X20, the base 331 is arranged between the plate 373 of the actuator 320 and the connecting piece 332. The base 331 is directly rotated about the axis X20 by the rotor 327 of the actuator 320, relative to the frame 12. The axis X20 is fixed relative to the frame 12 and relative to the base 331. By means of the base 331, the eccentric system 330 as a whole is rotated by the actuator 320 about the axis X20.

Figure 15:
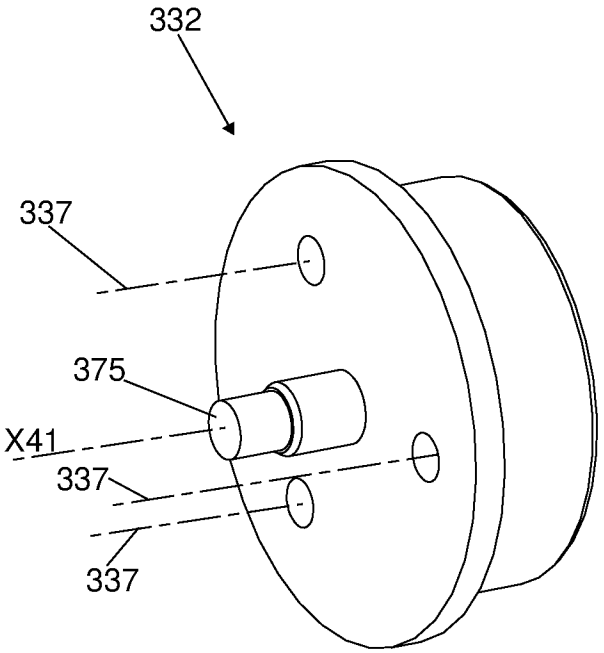
FIG. 15 is a perspective view of another portion of the shedding machine of FIGS. 11 to 14.

For this embodiment, the connecting piece 332 is formed by a crankpin, shown individually in FIG. 15. The eccentric system further comprises a flange 336 attached to the connecting piece 332, as is clearly visible in FIGS. 13 and 14.

In the present example, the flange 336 forms a flat piece, perpendicular to the axis X20 and traversed by the axis X20. Along the X20 axis, the flange 336 is arranged between the base 331 and the connecting piece 332. In the example, the connecting piece 332 is generally cylindrical in shape with a circular base and is centered on the X41 axis. The axes X41 and X20 are spaced apart from each other by the eccentric center distance R1. The connecting piece 332 projects relative to the flange 336 in a direction away from the actuator 320. In the example, the piece 332 is itself made by assembling two parts connected by a screw, but it could be provided that the connecting piece 332 is made of a single piece.

To achieve the assembly of the connecting piece 332 with the flange 336, it is advantageously provided that the connecting piece 332 comprises a finger 375, visible in FIGS. 13 and 15, coaxial with the axis X41, projecting from the connecting piece 332 in the direction of the flange 336 and passing through an opening 376 in the flange 336. The opening 376, visible in FIGS. 13 and 14, is advantageously coaxial with the axis X41. Furthermore, the fixing of the assembly of the flange 336 with the connecting piece 332 is for example carried out with the aid of fixing means such as screws, here three screws 337, parallel to the axis X41. These screws 337 are symbolized by their axis line in FIGS. 14 and 15. FIG. 14 shows three through openings belonging to the flange 336 and FIG. 15 shows three corresponding through openings belonging to the connecting piece 332, through which the screws 337 are received for the fixing of the flange 336 with the connecting piece 332.

Figure 11:
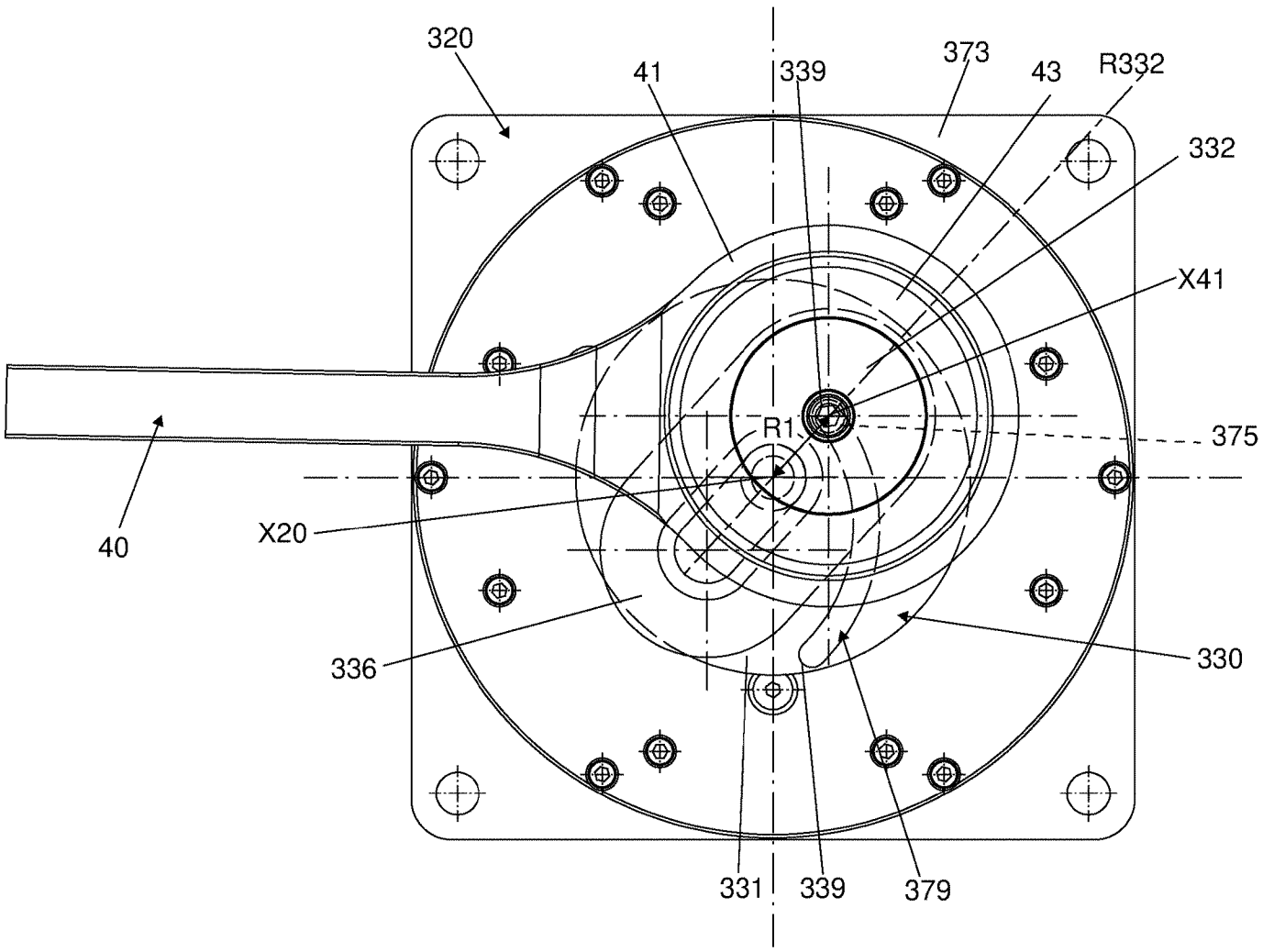
FIG. 11 is a partial front view of a shedding machine according to a fourth embodiment, showing in particular an eccentric system in a first configuration.
Figure 12:
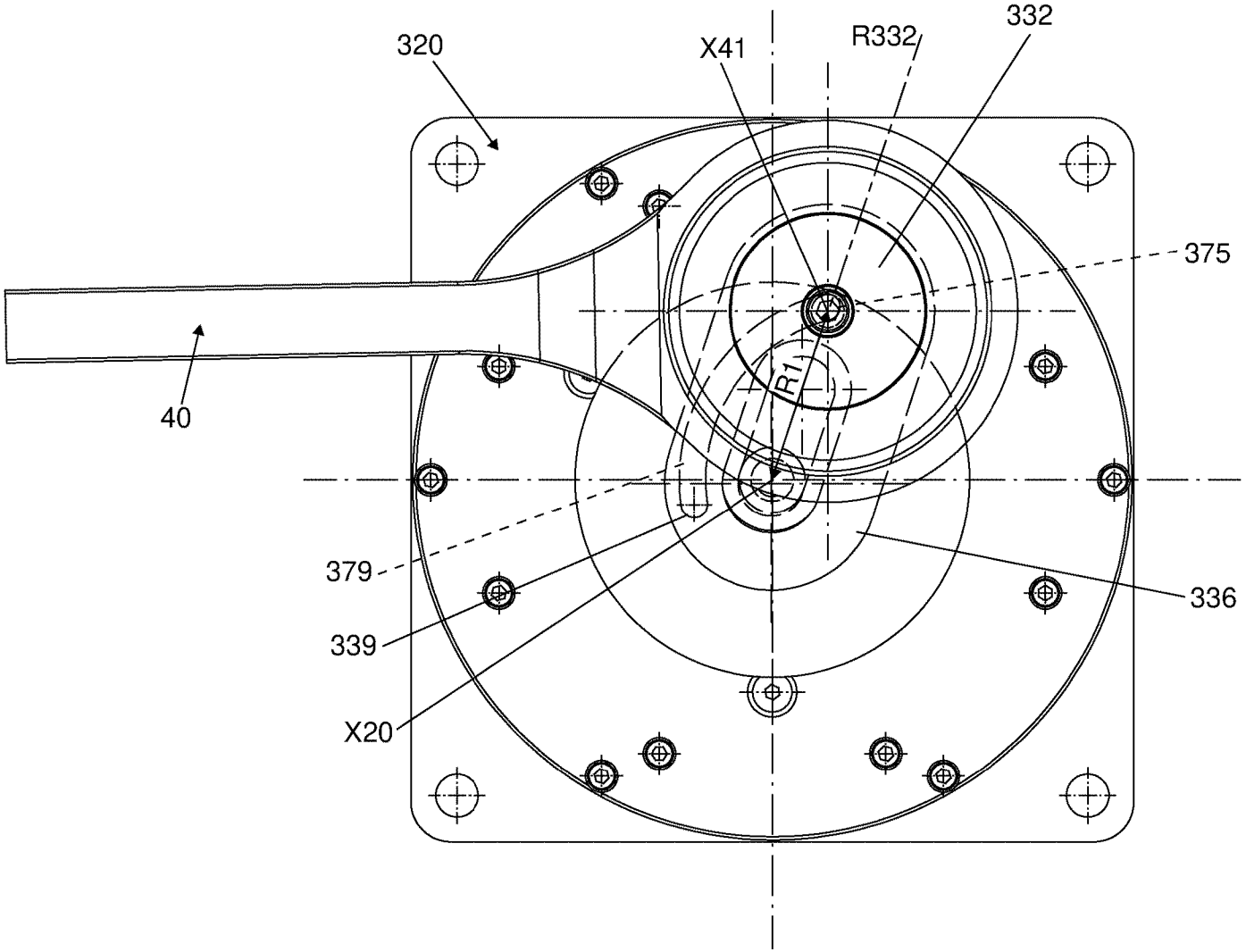
FIG. 12 is a view similar to FIG. 11, where the eccentric system is in a second configuration.

As shown in FIGS. 11 and 12, the articulation end 41 of the transmission rod 40 is coupled to the connecting piece 332, such that the transmission rod 40 and the connecting piece 332 are pivotable relative to each other about the eccentric axis X41, which is fixed relative to the transmission rod 40 and relative to the connecting piece 332. The circular flange of the articulation end 41 receives within it the crankpin formed by the connecting piece 332, absent from FIG. 14, but visible in FIGS. 11 to 13 and 15. The connecting piece 332 is pivotally supported within the end flange 41, by means of the bearing 43.

In this example, in order to achieve a variable distance R1 when the adjustment system is in the amplitude adjustment configuration, the connecting piece 332 is supported by the base 331 by, not only, being radially translatable relative to the base 331 along a translation axis R332, but also, being rotatable relative to the base 331 about the axis X20. The axis R332 is radial relative to the axis X20, in other words, it intersects the axis X20 and is perpendicular to the axis X20. For every position of the connecting piece 332 relative to the base, the axis R332 intersects the axis X20 and the axis X41. By movement in translation of the connecting piece 332 relative to the base 331 along the axis R332, the distance R1 is varied. Indeed, the axis X41 being fixed relative to the connecting part 332 and the axis X20 being fixed relative to the base 331, the relative displacement of these two parts varies the distance R1 which separates these axes X20 and X41.

To obtain that the connecting part 332 is both mobile relative to the base 331, while being able to be fixed in rotation and in radial translation relative to the base 331, it is provided, for example, that the flange 336 comprises an oblong opening 377, clearly visible in FIG. 14, and that the eccentric system 330 comprises a rod 378. The oblong opening 377 extends through the flange 336, from one side to the other, parallel to the axis X20. The oblong opening 377 is elongated along the translational axis R332 and extends along that axis R332. The rod 378 is coaxial with axis X20, and extends through the oblong opening 377, to support flange 336 by means of the oblong opening 377. The rod 378 supports and guides both a sliding of the oblong opening 377 along the axis R332, and a pivoting of the oblong opening about the axis X20.

Preferably, the rod 378 comprises a clamping screw 393 and a clamping nut 394, to thus form the locking means of the adjustment system for selectively fixing and allowing the variation of the distance R1. The screw 393 and nut 394 are threaded coaxially with the axis X20. The nut 394 is received in the oblong opening 377, so as to act as a bush for the sliding and rotation of the flange 336 when the adjustment system is in the amplitude adjustment configuration. Preferably, by screwing the screw 393 with the nut, the nut is axially supported against a peripheral edge of the oblong opening 377, in the direction of the actuator 320, and a head of the screw 393 is supported against the rotor 327, in the opposite direction, to immobilize the connecting piece 332 relative to the base 331 and to the rotor by tightening the flange 336 along the axis X20. Thus, to obtain the amplitude adjustment configuration, the screw 393 and the nut 394 are loosened, allowing translation and rotation of the connecting piece 332 relative to the base 331. To obtain the locked configuration, the screw 393 and the nut 394 are tightened, thereby securing the connecting piece 332 to the base 331. Also, the flange 336 is secured to the connecting piece 332 and the base 331.

As visible in FIG. 13, it is advantageously provided that the screw 393 extends through the actuator 320, such that a head of the screw 393 emerges at an end of the actuator 320, which is opposite to the end carrying the flange 336. The head of the screw 393 is thus very easily accessible to an operator, who needs to change the adjustment system between the adjustment configuration and the locked configuration, by screwing or unscrewing the screw 393 via its head.

Preferably, the adjustment system comprises an amplitude adjustment brake, which here comprises a spring 391, which is for example axially interposed between the rotor 327 and the head of the screw 393. Thus, even when the screw 393 and the nut 394 are loosened, the spring applies, by elasticity, an axial force that keeps the flange 336, and therefore the connecting piece 332, slightly in axial support against the base 331, under the action of the nut 394. Thus, the spring 391, combined with the screw 393 and the nut 394, brakes the movement of the connecting piece 332 relative to the base 331 while the adjustment system is in the amplitude adjustment configuration.

In order to allow a particularly precise adjustment of the distance R1, while making possible an adjustment by rotation of the base 331 according to the method described above and illustrated in FIG. 17, it is provided here that the radial translation position of the connecting piece 332 relative to the base 331, along the axis R332, is subject to the orientation of the connecting piece 332 relative to the base 331 about the main axis X20. In other words, pivoting the connecting piece 332 and the flange 336 relative to the base 331 about the axis X20 causes the radial translation of the connecting piece 332 and the flange 336 relative to the base 331 along the axis R332, and vice versa. Thus, the movement of the connecting piece 332 and the flange 336 relative to the base 331 occurs according to a single trajectory, including radial translation and rotation. It is advantageously provided that, for an initial orientation of the connecting piece 332 relative to the base 331, shown in FIG. 11, the radial translation position of the connecting piece 332 corresponds to a minimum distance R1 between the axes X20 and X41. When the connecting piece 332 is pivoted from this initial orientation in the same direction, the radial translation of the connecting piece 332 is in one direction only along the axis R332, gradually increasing the distance R1 to a maximum shown in FIG. 12. When the connecting piece 332 is rotated from the orientation shown in FIG. 12 in the opposite direction, the radial translation of connecting piece 332 is also performed in the opposite direction along the axis R332, until gradually returning to the minimum distance R1 shown in FIG. 11.

In order to obtain this subjection of the radial translation with the orientation of the connecting piece 332, relative to the base 331, it is provided that the base 331 comprises a cam groove 379, and that the connecting piece 332 comprises a follower finger, here formed by the finger 375, the follower finger 375 being received in the cam groove 379 in order to be constrained to circulate along the said cam groove 379.

The cam groove 379 is here constituted by a groove, which is formed on the surface of the base 331 and which opens towards the connecting piece 332. The cam groove 379 has a spiral shape. In other words, the cam groove 379 describes, along the surface of the base 331, a spiral path, which circumvents the axis X20, as clearly visible in FIGS. 11, 12 and 14.

As shown in FIG. 13, the finger 375 projects axially from the flange 336 in the direction of the base 331, so that its end is received in the cam groove 379. In practice, the finger 375 extends through the opening 376 and through the flange 336, going further than the flange 336, to the groove 379. Thus, received in the groove 379, the finger 375 is slidably guided along the said groove 379 and is then constrained to remain on the path it describes. Here, the axis X41 follows the same trajectory as the finger 375, being coaxial with this finger 375. Because the finger 375 cooperates with the groove 379 to travel according to a single path, the radial translation and pivoting of the connecting piece 332 is fully constrained. The opening 376 constitutes the means for positioning the finger follower 375 in the cam groove 379.

As a variant, it may be provided that the finger follower 375 is integral with the flange 336.

The groove 379 comprises ends 339, which, together with the finger 375, form the amplitude adjustment stops belonging to the adjustment system, in that the ends 339 limit the movement of the finger 375 along the groove, as shown in FIGS. 11 and 12, respectively. As a result, the radial translation of the connecting piece 332 is limited between a position, that of FIG. 11, in which the value of the distance R1 is minimal, and a position, that of FIG. 12, in which the value of the distance R1 is maximal.

More generally, in order to obtain the amplitude adjustment configuration, it is provided that the connecting piece 332 is movable along a predetermined trajectory relative to the base 331, by cooperation between a cam groove and cam follower carried by these pieces, to vary the center distance R1. Here, the locking means is formed by the flange 336, the clamping screw 393 and the clamping nut 394, to fix the position of the connecting piece 332 relative to the base 331, along the cam groove 379, to obtain the locked configuration. However, another locking means could be provided to fix the position of the connecting piece 332 relative to the base 331. According to the chosen solution, the rotation of the piece 332 is not necessarily subject to radial translation.

Figure 16:
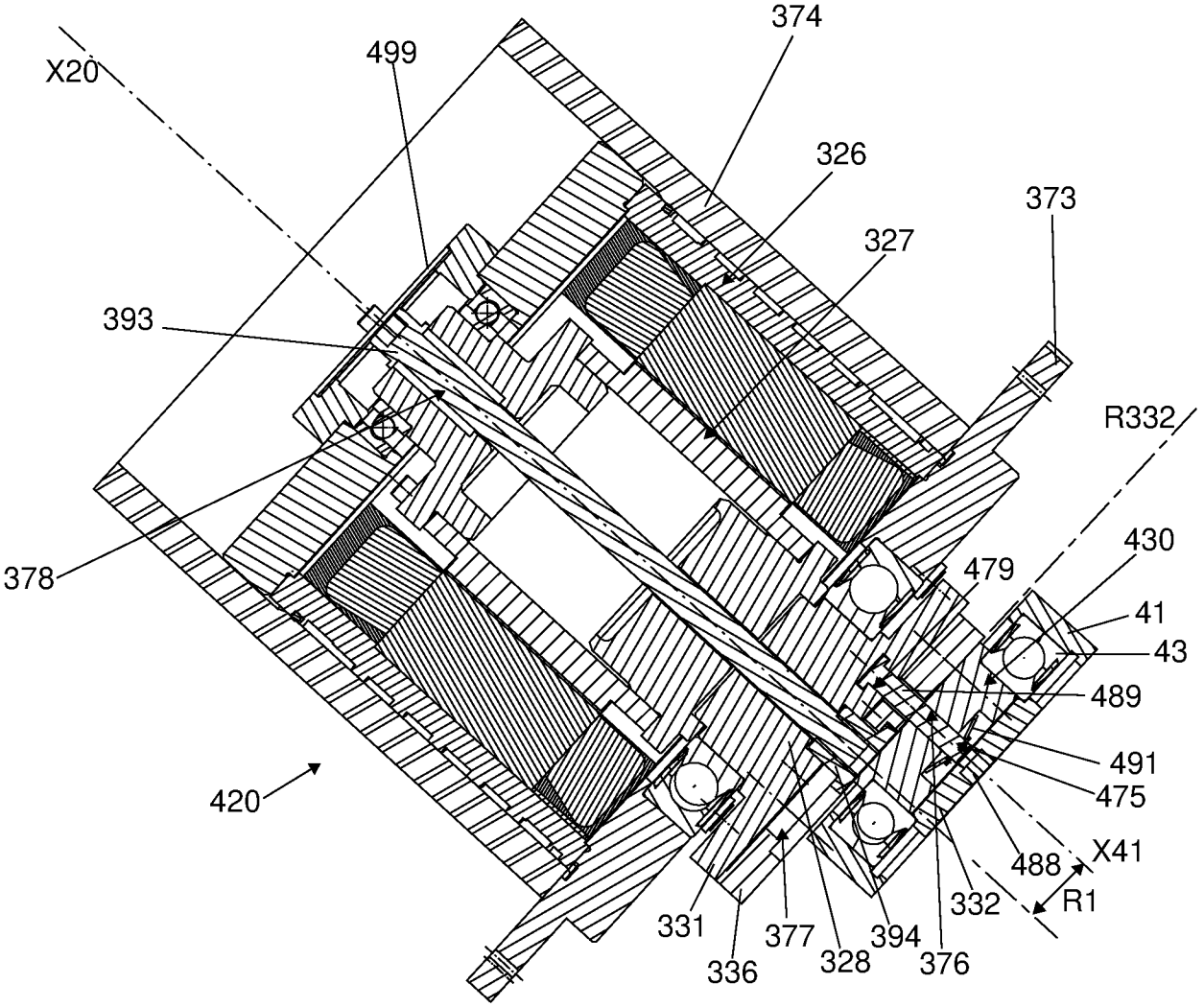
FIG. 16 is a cross-section of a shedding machine according to a fifth embodiment of the invention.

FIG. 16 shows an actuator 420, an eccentric system 430 for a fourth embodiment, with a loom identical to the loom 1 of FIGS. 1 to 7, except specifically for the actuator 420 and the eccentric system 430, replacing the actuator 20 and the eccentric system 30. The actuator 420 and the eccentric system 430, however, perform the same functions.

The actuator 420 is identical to the actuator 320 and the eccentric system 430 is identical to the eccentric system 330 except for the differences mentioned below. The identical components are shown in FIG. 16 with the same reference signs as for actuator 320.

For the eccentric system 430, the finger follower 375 is replaced with a finger follower 475, which is identical to the finger follower 375 except for the differences below. For the eccentric system 430, the cam groove 379 is replaced with cam groove 479, identical to cam groove 379 except for the differences below.

Preferably, the finger follower is a nut 489 having a head, which is radially projecting relative to the axis X40, and which is received in the cam groove 479, which presents flanges axially capturing the head of the nut 489. In other words, the cam groove 479 presents a complementary T-shaped cross-section with the nut head 489.

Preferably, for this embodiment, the rod 378 performs the function of a locking means without ensuring the function of a braking means, while the finger follower 475 and a spring 491, described below, ensure the function of a braking means without ensuring the function of a locking means.

Preferably, the spring 491 is, for example, axially interposed between the connecting piece 332 and the nut 489. The spring 491 is here constituted by a spring washer present in a groove of the nut 489. Thus, even when the rod 378 and the nut 394 are loosened, the spring applies, by elasticity, an axial force which maintains the connecting piece 332 slightly in axial support against the base 331, under the action of the nut 489 cooperating with the edges of the cam groove 479. Thus, the spring 491, combined with the nut 489, brake the movement of the connecting part 332 relative to the base 331 while the adjustment system is in an amplitude adjustment configuration. In the case where braking is provided by the spring 491, the spring 391 is advantageously not required.

It may also be provided that the spring washer 491 is positioned under a screw head and not in a groove in the nut 489, and that the tightening of this screw relative to the nut 489 is used to adjust the braking intensity of the washer, in other words, the braking torque best suited to maintain the relative position between the connecting piece 332 and the base 331.

In a variant not shown, it can be provided that the finger follower 475 ensures both the locking and braking function. In this case, the finger follower 475 is in two parts. The finger follower 475 comprises the nut 489 and a clamping screw not shown, but the location of which is designated by reference 488. The clamping screw is screwed into the nut 489 coaxially with the axis X40. The clamping screw then presents a head, which is accessible from an axial face of the connecting piece 332 for screwing in and pressing against the connecting piece 332. Tightening the clamping screw with the nut 489 brings the head of the clamping screw into axial contact against the connecting piece 332 and the head of the nut into axial contact, in the opposite direction, against the edges of the cam groove 479, thereby preventing movement of the connecting part 332 relative to the base 331 by locking. This variant does not require the use of the rod 378 for locking. In the case where locking is ensured by the finger follower 475 as described above, it can be provided that the screw 393 and the nut 394 of the rod 378 do not serve as a means of locking the amplitude adjustment system. During weaving and during adjustment, the screw 393 and nut 394 are loosened to always allow the movement of the flange 336 and the connecting piece 332 relative to the base 331, by cooperation of the rod 378 with the oblong opening 377. Advantageously, a cover 499 is then provided to prevent access to the screw head of the rod 378 by an operator.

For this variation, in the amplitude adjustment configuration, the clamping screw and nut 489 are loosened, so that the finger follower 475 travels in the cam groove 479 to allow adjustment of the center distance R1, in a manner similar to the finger follower 375. In the locked configuration, the clamping screw and nut 489 are tightened, so that the connecting piece 332 is fixed relative to the base 331. The finger follower 475 thus provides the locking means for the amplitude adjustment system.

For this variant, it may be provided that the actuator 420 comprises a resolver through which the clamping screw 393 passes.

Any feature described above for one embodiment or variant may be implemented for the other embodiments and variants, as far as technically possible.

The invention claimed is:

1. A shedding machine for operating a heald frame of a loom according to a reciprocating stroke along a frame axis, the shedding machine comprising:

a rotary electric actuator;

a controller adapted to control the rotary electric actuator an eccentric system, which comprises:

a base by means of which the eccentric system is driven in rotation, by the rotary electric actuator, about a main axis perpendicular to the frame axis, and a connecting piece defining an eccentric axis, which is parallel to the main axis;

a lever, which is pivoted in an oscillating way about a lever axis to actuate said heald frame, the lever axis and the main axis being parallel;

a transmission rod, which comprises:

a first articulation end, by means of which the transmission rod is coupled to the connecting piece such that the eccentric system and the transmission rod are pivotable relative to each other about the eccentric axis, the eccentric axis and the main axis being spaced apart by an eccentric center distance, and a second articulation end, by means of which the transmission rod is coupled to the lever, so that the lever and the transmission rod are pivotable relative to each other about a transmission rod axis, which is parallel to the main axis, the transmission rod axis and the eccentric axis being spaced apart by a transmission rod center distance;

an adjustment system, which comprises locking means and which allows:

at least one adjustment configuration, among:

an amplitude adjustment configuration, in which the locking means allow a movement of the connecting piece relative to the base such that the eccentric center distance is adjustable, and a height adjustment configuration, wherein the locking means allow movement of the second articulation end relative to the first articulation end such that the transmission rod center distance is adjustable; and a locked configuration, in which the eccentric center distance and the transmission rod center distance are fixed, in that the locking means are configured so that the connecting piece is fixedly secured to the base and the first articulation end is fixedly secured to the second articulation end; and a locking system, which allows for a locked configuration, where the locking system locks the orientation of the lever, when the lever is in a reference orientation, and a release configuration, where the locking system allows pivoting of the lever.

2. The shedding machine according to claim 1, wherein the locking system comprises a stop, which, in order to lock the pivoting of the lever, cooperates mechanically with the lever, and, in order to allow the pivoting of the lever, is released from the lever.

3. The shedding machine according to claim 1, wherein, in order for the eccentric center distance to be adjustable when the adjustment system is in the amplitude adjustment configuration, the connecting piece and the base are pivotable relative to each other about a crank axis, which is fixed relative to the base and relative to the connecting piece, and which is parallel to the main axis.

4. The shedding machine according to claim 3, wherein the connecting piece comprises a crankpin, coaxial with the crank axis, and the base comprises a pinch ring receiving the crankpin, the base carrying the connecting piece by means of the crankpin received in the pinch ring.

5. The shedding machine according to claim 3, wherein the base comprises a crankpin, coaxial with the crank axis, and the connecting piece comprises a pinch ring receiving the crankpin, the base carrying the connecting piece by means of the crankpin received in the pinch ring.

6. The shedding machine according to claim 4, wherein the locking means comprises a clamping screw, which:

in the locked configuration of the adjustment system, is in a clamping position of the pinch ring about the crankpin, to secure the connecting piece to the base, and in the amplitude adjustment configuration of the adjustment system, is in a position of loosening the pinch ring about the crankpin, to allow the pivoting of the connecting piece relative to the base, by pivoting the crankpin in the pinch ring.

7. The shedding machine according to claim 1, wherein the base comprises a cam groove defining a spiral about the main axis, and the connecting piece comprises a finger follower, which travels along the cam groove to guide the connecting piece relative to the base, when the adjustment system is in an amplitude adjustment configuration and thus varies the eccentric center distance.

8. The shedding machine according to claim 7, wherein the eccentric system comprises:

a flange, which extends perpendicular to the main axis, which comprises:

means for positioning the finger follower in the cam groove, and an elongated oblong opening along a translation axis; and a rod, which is coaxial with the main axis and is received in the oblong opening to support the flange by means of the oblong opening.

9. The shedding machine according to claim 8, wherein:

the locking means comprises a clamping screw and a clamping nut, which form the rod, the clamping screw and the clamping nut being mutually screwed along the main axis;

in the locked configuration of the adjustment system, the flange is fixedly secured with the base, being axially clamped against the base, by screwing the clamping screw into the clamping nut, to immobilize the connecting piece along the spiral path relative to the base and thus fix the eccentric center distance; and in the amplitude adjustment configuration, movement of the connecting piece relative to the base is allowed, by loosening the clamping screw of the clamping nut.

10. The shedding machine according to claim 1, wherein the transmission rod comprises a first transmission rod end, carrying the first articulation end, and a second transmission rod end, carrying the second articulation end, the first transmission rod end and the second transmission rod end being slidably inserted relative to each other along a sliding axis such that the connecting rod center distance is adjustable.

11. The shedding machine according to claim 1, wherein the adjustment system comprises adjustment stops, among:

amplitude adjustment stops, limiting the movement of the connecting piece to limit the variation of the eccentric center distance between a predetermined minimum eccentric center distance value and a maximum eccentric center distance value, in the case where the adjustment system can be put into the amplitude adjustment configuration; and height adjustment stops, limiting the movement of the second articulation end to limit the variation of the connecting rod center distance between a predetermined minimum connecting rod center distance value and a predetermined maximum connecting rod center distance value, in case the adjustment system may be put into the height adjustment configuration.

12. The shedding machine according to claim 1, wherein the adjustment system comprises at least one brake, among:

an amplitude adjustment brake, configured to maintain the position of the connecting piece relative to the base below the application of a determined relative displacement force while the adjustment system is in an amplitude adjustment configuration; and a height adjustment brake, configured to maintain the position of the second articulation end relative to the first articulation end below the application of a predetermined relative displacement force while the adjustment system is in a height adjustment configuration.

13. The shedding machine according to claim 1, wherein the adjustment system comprises at least one set of graduations, among:

a set of amplitude adjustment graduations, indicating an amplitude adjustment value depending on the eccentric center distance; and a set of height adjustment graduations, indicating an amplitude adjustment value depending on the connecting rod center distance.

14. The shedding machine according to claim 1, wherein the controller is able to control the rotary electric actuator to vary the eccentric center distance in the amplitude adjustment configuration or to vary the connecting rod center distance in the height adjustment configuration.

15. A loom, comprising the shedding machine according to claim 1, and the heald frame operated by the shedding machine.

16. An adjusting method, for adjusting the shedding machine according to claim 1, the adjusting method comprising successively:

a step of pivoting the lever to the reference orientation, by rotating the eccentric system while the adjustment system is in the locked configuration and the locking system is in the release configuration;

a step of putting the locking system in the locking configuration;

a step of putting the adjustment system in the adjustment configuration; and in the case that the adjustment system is in the amplitude adjustment configuration, a step of adjusting the eccentric center distance by rotating the eccentric system by a predetermined value, and in the case that the adjustment system is in the height adjustment configuration, a step of adjusting the connecting rod center distance by rotating the eccentric system by a predetermined value.

17. The adjusting method according to claim 16, wherein, for the step of adjusting, the rotating of the eccentric system is performed by a rotational control of the rotary electric actuator.

18. The adjusting method according to claim 17, wherein the rotary electric actuator is rotationally controlled according to a target value or incremental value relative to a desired frame stroke or a desired frame height.

19. The adjusting method according to claim 16, wherein the adjustment system comprises adjustment stops, among:

amplitude adjustment stops, limiting the movement of the connecting piece to limit the variation of the eccentric center distance between a predetermined minimum eccentric center distance value and a maximum eccentric center distance value, in the case where the adjustment system can be put into the amplitude adjustment configuration; and height adjustment stops, limiting the movement of the second articulation end to limit the variation of the connecting rod center distance between a predetermined minimum connecting rod center distance value and a predetermined maximum connecting rod center distance value, in case the adjustment system may be put into the height adjustment configuration, and wherein the adjusting method comprises a prechecking step, performed after the step of putting the adjustment system to the adjustment configuration and before the step of adjusting, the prechecking step comprising:

a step of requesting a rotation of the rotary electric actuator in a first direction of rotation until an adjustment stop is reached;

a step of measuring a first rotation angle described by the eccentric system having reached the adjustment stop;

a step of comparing the measured first rotation angle with a predetermined first angle corresponding to the rotation expected from the position of the adjustment stop to establish whether the shedding machine is in a nominal situation or in a fault situation, such as a loosening fault or an adjustment fault; and a step of issuing an alarm, in the case where it has been established that the shedding machine is in the fault situation.

20. The adjusting method according to claim 19, wherein the prechecking comprises, before the step of requesting the rotation of the rotary electric actuator in the first direction of rotation:

a step of requesting a rotation by the rotary electric actuator in a direction of rotation, opposite to the first direction of rotation, until reaching an adjustment stop;

a step of measuring a second rotation angle described by the eccentric system having reached the adjustment stop; and step of comparing the measured second angle of rotation with a second predetermined angle corresponding to the rotation expected from the position of the stop, to establish whether the shedding machine is in a nominal situation or in a fault situation, such as a loosening fault or an adjustment fault.

21. The adjusting method according to claim 16, wherein, after the step of adjusting, the adjusting method comprises, successively:

a step of putting the adjustment system in a locked configuration; and a step of putting the locking system in a release configuration.

22. The adjusting method according to claim 16, wherein the adjusting method comprises a locking check step between the step of putting the locking system in the locked configuration and the step of putting the adjustment system in the adjustment configuration, which comprises:

a step of checking that the rotary actuator does not rotate under the application of a predetermined torque value, and a step of issuing an alarm signaling a locking fault in case a rotational movement of the rotary electric actuator is detected.

23. The adjusting method according to claim 21, wherein the adjusting method comprises a locking check step, between the step of putting in locked configuration and the step of putting in release configuration, which comprises:

a step of checking that the rotary electric actuator does not rotate under the application of a predetermined torque value, and a step of issuing an alarm signaling a locking failure in case a rotational movement of the rotary electric actuator is detected.

24. The adjusting method according to claim 16, wherein the adjusting method comprises cutting off a power supply to the rotary electric actuator during the step of putting in the adjusting configuration.

* * * * *